US005428341A

United States Patent [19]

Takahashi

[11] Patent Number: 5,428,341

[45] Date of Patent: Jun. 27, 1995

[54] FIRE RECEIVER

[75] Inventor: Keiichi Takahashi, Tokyo, Japan

[73] Assignee: Nohmi Bosai Ltd., Tokyo, Japan

[21] Appl. No.: 215,811

[22] Filed: Mar. 22, 1994

[30] Foreign Application Priority Data

Mar. 25, 1993 [JP] Japan ..... 5-090938
Mar. 30, 1993 [JP] Japan ..... 5-097098

[51] Int. Cl.[6] ..... G08B 29/00; G08B 23/02

[52] U.S. Cl. ..... 340/506; 340/505; 340/517; 340/525; 340/825.06; 340/825.07; 364/146

[58] Field of Search ..... 340/506, 505, 517, 525, 340/588, 589, 825.06–825.13; 364/140, 141, 144, 146, 188

[56] References Cited

U.S. PATENT DOCUMENTS 5,017,905 5/1991 Yuchi et al. ..... 340/505
5,189,394 2/1993 Walter et al. ..... 340/525
5,227,763 7/1993 Kikuchi ..... 340/505

*Primary Examiner*—Donnie L. Crosland
*Attorney, Agent, or Firm*—Wenderoth, Lind & Ponack

[57] ABSTRACT

A fire receiver including: an operation selection switch for selecting a desired operation from a plurality of operations that can be executed; an address selection switch for selecting a desired address from different addresses respectively given to a plurality of fire detectors and lines; an address changing device for continuously changing the address to be selected in accordance with the operation of the address selection switch; an address display device for displaying the address to be instructed which has been changed by the address changing device; and a command device for commanding a fire detector or a line corresponding to the address displayed by the address display device to perform the operation selected by the operation selection switch.

20 Claims, 20 Drawing Sheets

FIG. 14A

1a

MENU

1. TEST
2. MAINTENANCE
3. INTERLOCK CUT-OFF
4. DATA LIST
5. GUIDE LIST

INPUT No. BY USING TEN KEY, AND DEPRESS EXECUTION KEY

FIG. 14B

1a

TEST

1. OPERATION TEST
2. MANUAL FIRE TEST
3. AUTOMATIC FIRE TEST
4. AUXILIARY POWER SUPPLY TEST
5. DISPLAY PORTION TEST

INPUT No. BY USING TEN KEY, AND DEPRESS EXECUTION KEY

FIG. 14C

1a

MANUAL FIRE TEST

INPUT ADDRESS OF LINE INTENDED TO BE TESTED BY USING TEN KEY, AND DEPRESS EXECUTION KEY

FIG. 14D

1a

GUIDE LIST

1. TERMINAL CONTROL GUIDE
2. GUIDE FOR USE IN TROUBLE
3. TEST GUIDE

INPUT No. BY USING TEN KEY, AND DEPRESS EXECUTION KEY

FIG. 14E

1a

GUIDE FOR USE IN TROUBLE

1. MAIN SIGNAL LINE ENCOUNTERED TROUBLE DISPLAYED RELAY ENCOUNTERED A TROUBLE OR MAIN SIGNAL LINE IS DISCONNECTED OR SHORT-CIRCUITED
2. SUPERVISORY LINE ENCOUNTERED A TROUBLE

FIRE RECEIVER

BACKGROUND OF THE INVENTION

FIELD OF THE INVENTION

This invention relates to a fire receiver that receives fire information from a fire detector to display a fire area and the like and to control devices, such as fire-block and smoke exhausting devices and fire extinguishing devices and the like, which are the subjects to be controlled, in accordance with fire information.

DESCRIPTION OF THE RELATED ART

When a fire test is manually performed to examine a fire detector or a line of a conventional fire receiver, the address of the fire detector or the line, which is the subject of the fire test, is supplied by using a ten key and an execution key is depressed after the address has been supplied to start executing the fire test.

That is, "1" is inputted by using a ten key to select "Test" shown on a menu screen of a display unit 1*a* as shown in FIG. 14A, and then an execution key is depressed. Then, "2" is inputted by using the ten key to select "Manual Fire Test" displayed on a test screen shown in FIG. 14B, and the execution key is depressed. Then, the address of the line intended to be tested is inputted through the screen of the manual fire test shown in FIG. 14C, and the execution key is depressed.

Since the thus-constituted conventional example is arranged in such a manner that the address of the line is inputted by using the ten key, the key operation must be performed by the times which are the same as the number of digits of the address, the keys to be depressed being usually different from one another. The operator must perform the key operation while looking at the ten key whenever the operator inputs one of the digits of the address. Therefore, a problem is raised in that the key operation is troublesome, and another problem is raised in that it takes a very long time to set the address. If an erroneous address is inputted, the address input operation must be again performed. What is worse, there arises another problem in that the re-input operation to be performed after the error has been made in the address inputting operation is too complicated. Although the foregoing conventional example is adapted to a case where the fire test is performed for each line, similar problems arise if the fire test is performed for each fire detector.

In the display unit 1*a*, "5. Guide List" is displayed on the lowermost line of the menu screen shown in FIG. 74A. When "5" corresponding to the guide list is inputted by using the ten key, a guide list screen shown in FIG. 14D is displayed, the guide list screen having "1. Terminal Control Guide", "2. Guide in case of Trouble Takes Place" and "3. Test Guide" displayed thereon. Among the foregoing guides, the number corresponding to the required guide is inputted by using the ten key. If the Guide in case of Trouble Takes Place is selected, key "2" of the ten key is depressed. As a result, the specific contents of the Guide in case of Trouble Takes Place are displayed as shown in FIG. 14E. By reading the contents of the guide, the description about the key operation and the like to be performed if a trouble takes place can be understood.

However, the description about the key operation can be displayed on the display unit la by depressing the ten key two times while looking at the menu screen. Thus, the key operation is too complicated and the operation cannot be completed quickly. When a screen, such as a maintenance screen or an interlock cut-off screen, except that the menu screen is displayed, the guide for the description about the relative key operation and so forth can be displayed by performing switching to the menu screen and by depressing the ten key two times afterwards. Therefore, the foregoing operation is too complicated and the operation cannot be completed in a short time.

SUMMARY OF THE INVENTION

An object of the present invention is to provide a fire receiver in which an operation for setting the address of a fire detector or a line, which must be subjected to a fire test, can easily be performed and the address setting operation can quickly be completed.

According to a first aspect of the present invention, there is provided a fire receiver comprising: operation selection switch means for selecting a desired operation from a plurality of operations that can be executed; address selection switch means for selecting a desired address from different addresses respectively given to a plurality of fire detectors and lines; address changing means for continuously changing the address to be selected in accordance with the operation of the address selection switch means; address display means for displaying the address to be instructed which has been changed by the address changing means; and command means for commanding a fire detector or a line corresponding to the address displayed by the address display means to perform the operation selected by the operation selection switch means.

According to a second aspect of the present invention, there is provided a fire receiver connected to devices in a fire alarm system, the fire receiver comprising: a CPU; operation switch means connected to the CPU; a transmitting/receiving circuit connected to the CPU and arranged to transmit/receive signals to and from the devices in the fire alarm system; and display means connected to the CPU, wherein the display means includes: an operation display portion for displaying the state of the operation performed by the fire alarm system; a menu display portion for displaying a plurality of menus of the contents of operations; and an operation description display portion for displaying the description of a switch operation about the contents of the operation of a menu of the plurality of the menus of the contents of the operations displayed in the menu display portion that has been selected by the operation switch means.

BRIEF DESCRIPTION OF THE DRAWINGS

FIGS. 14A to 14E are views which illustrate examples of displays made by a display unit of a conventional fire receiver.

DESCRIPTION OF THE PREFERRED EMBODIMENTS

Preferred embodiments of the present invention will now be described with reference to the drawings.

FIRST EMBODIMENT

Figure 1:
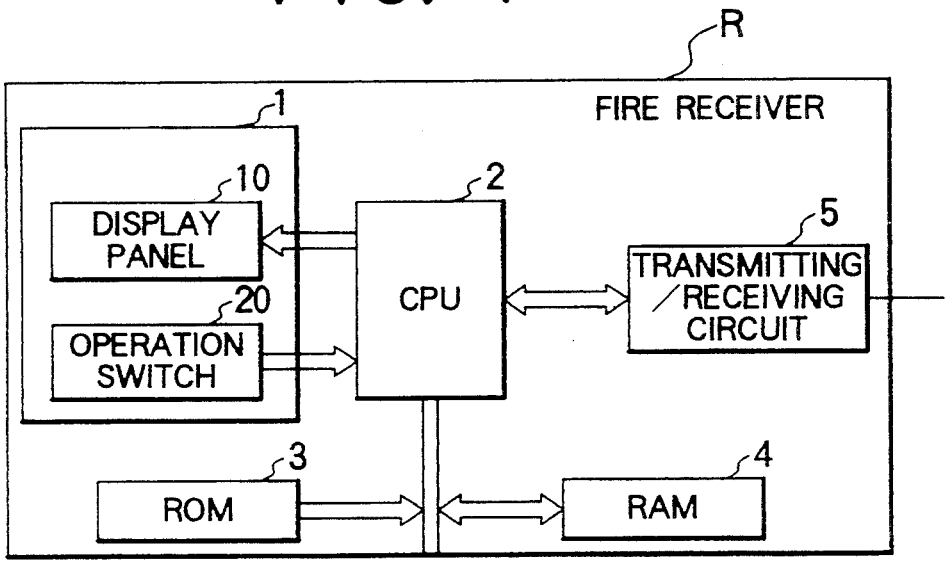
FIG. 1 is a block diagram which illustrates a fire receiver according to a first embodiment of the present invention.
Figure 3A:
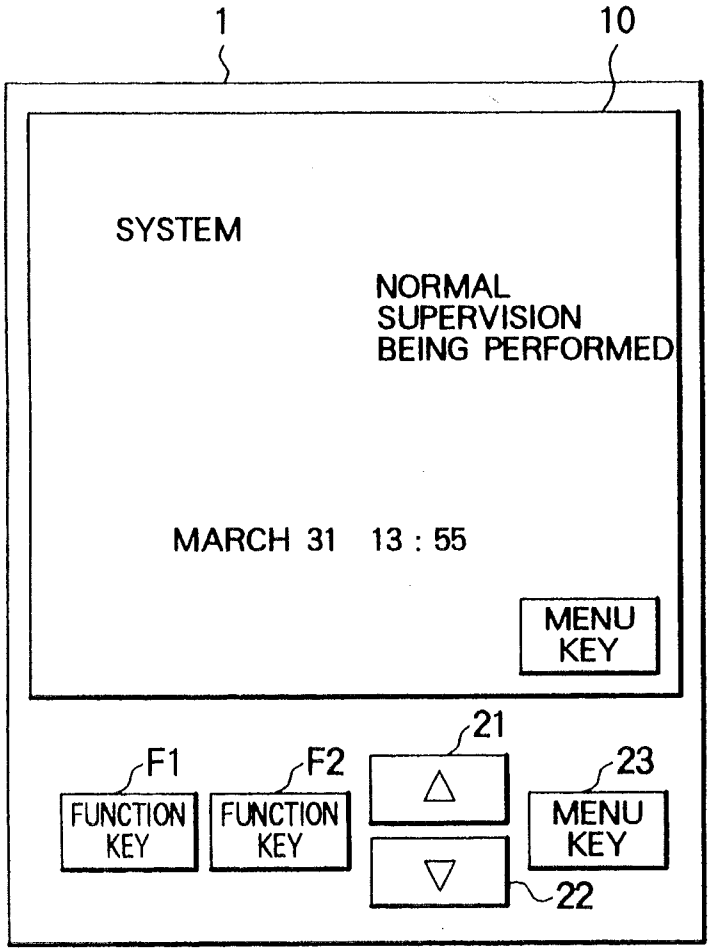
FIGS. 3A to 3D are views which illustrate examples of displays made by the display unit shown in FIG. 2.
Figure 3B:
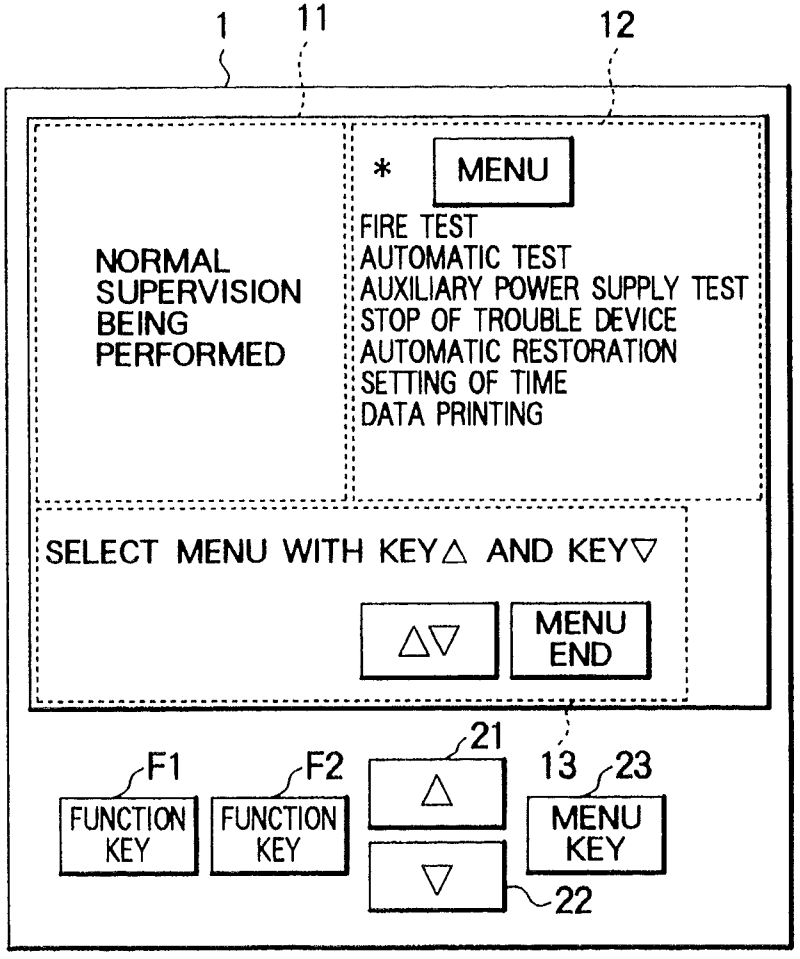
Figure 3C:
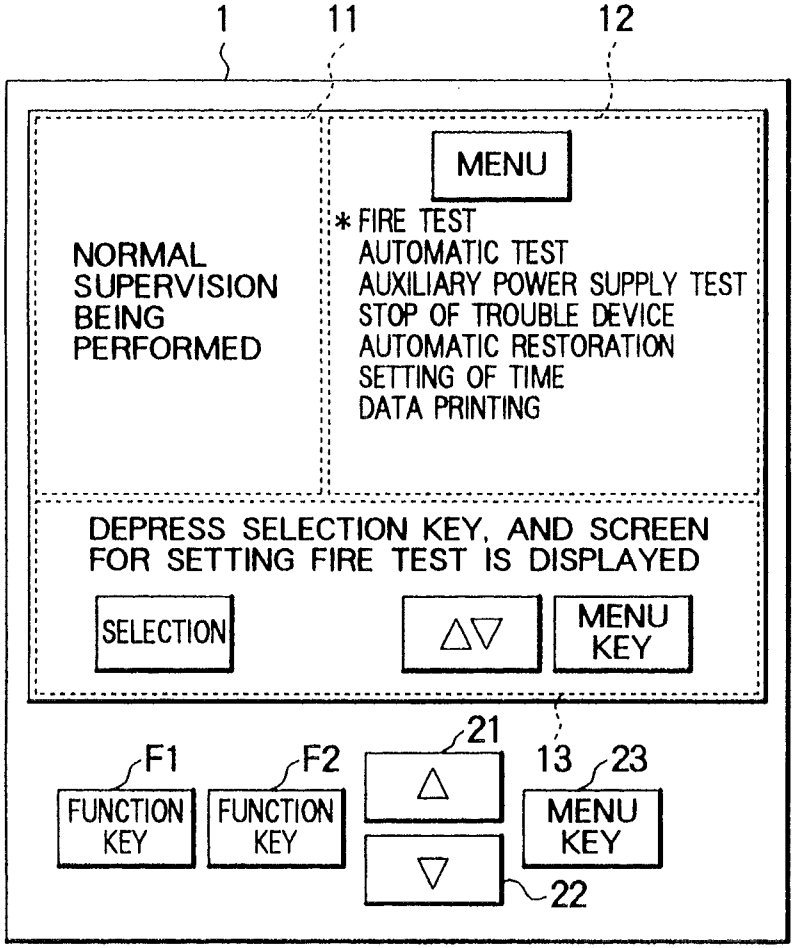
Figure 3D:
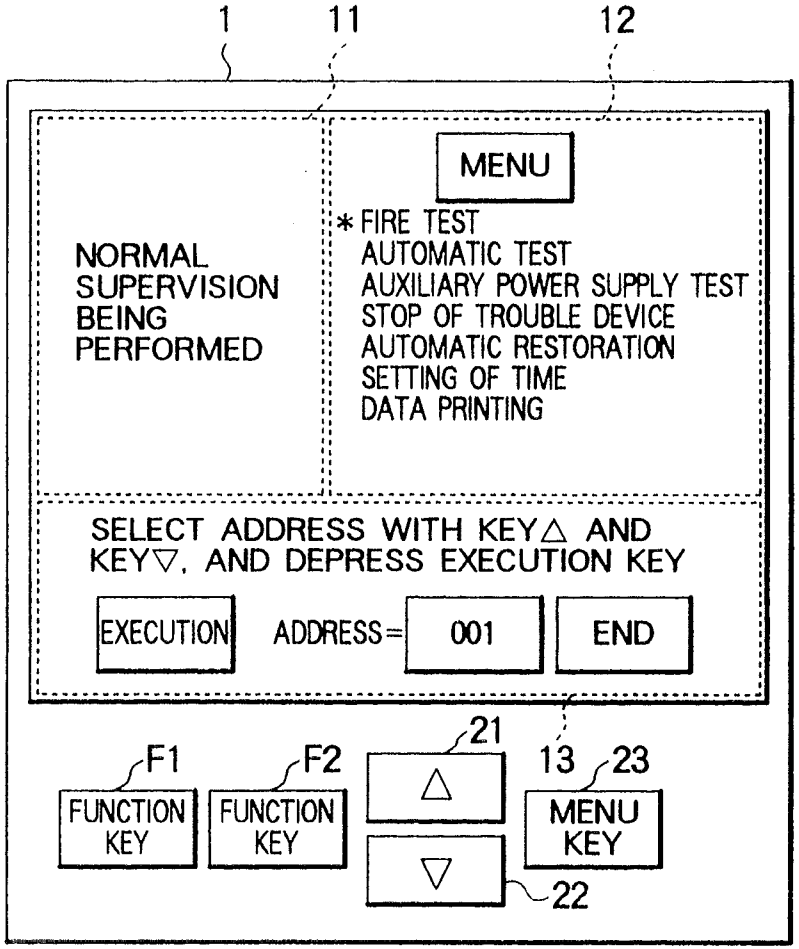
Figure 4:
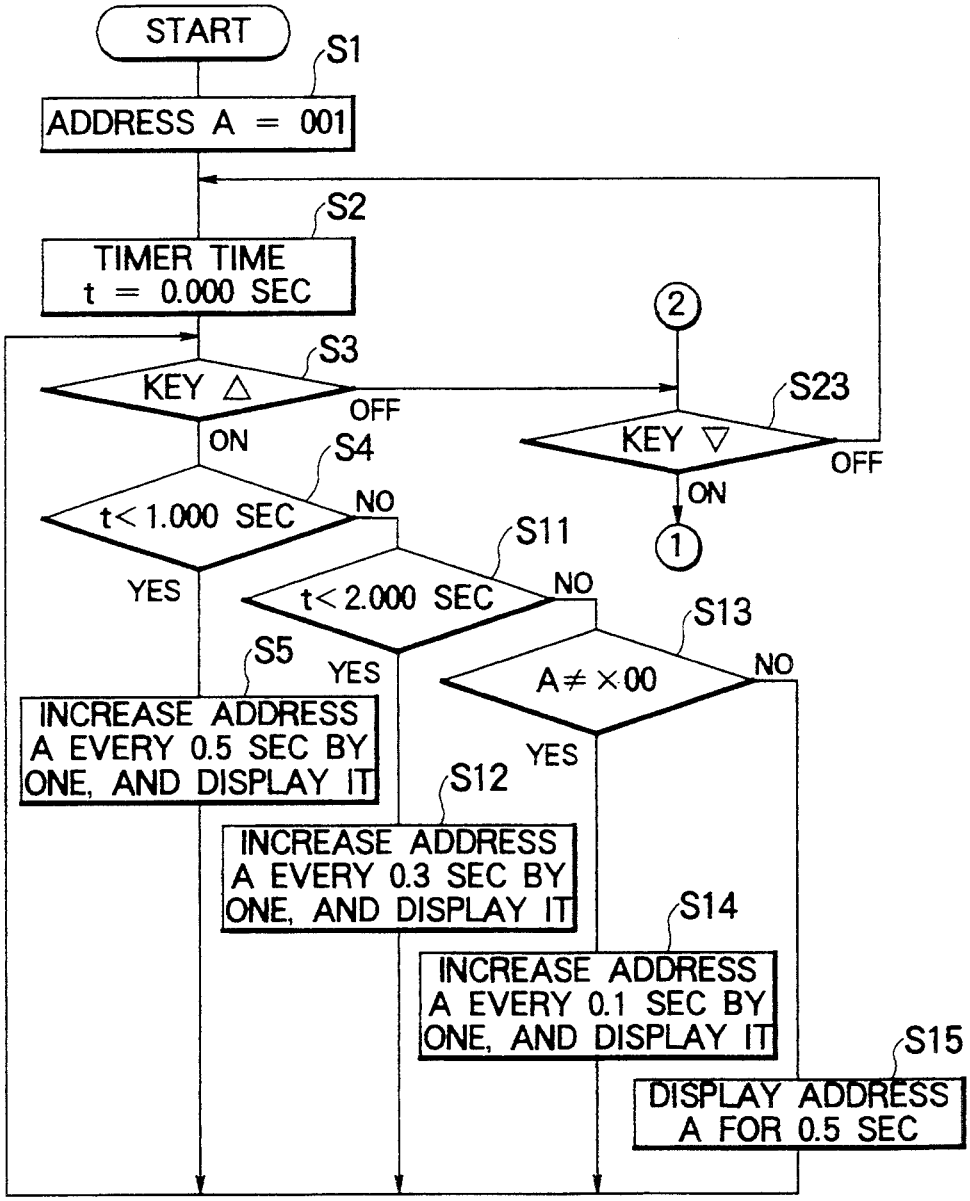
FIGS. 4 and 5 are flow charts of the operation of the first embodiment.

Referring to FIG. 1, a fire receiver R according to a first embodiment of the present invention comprises a display unit 1, a CPU (a microcomputer) 2 or controlling the total operation of the receiver R, a ROM 3 in which a program to be executed in accordance with a flow chart shown in FIGS. 3 and 4 is stored, a RAM 4 for use as a working space and a transmitting/receiving circuit 5 for transmitting/receiving signals to and from a fire detector or the like through a line connected to the receiver R.

Figure 2:
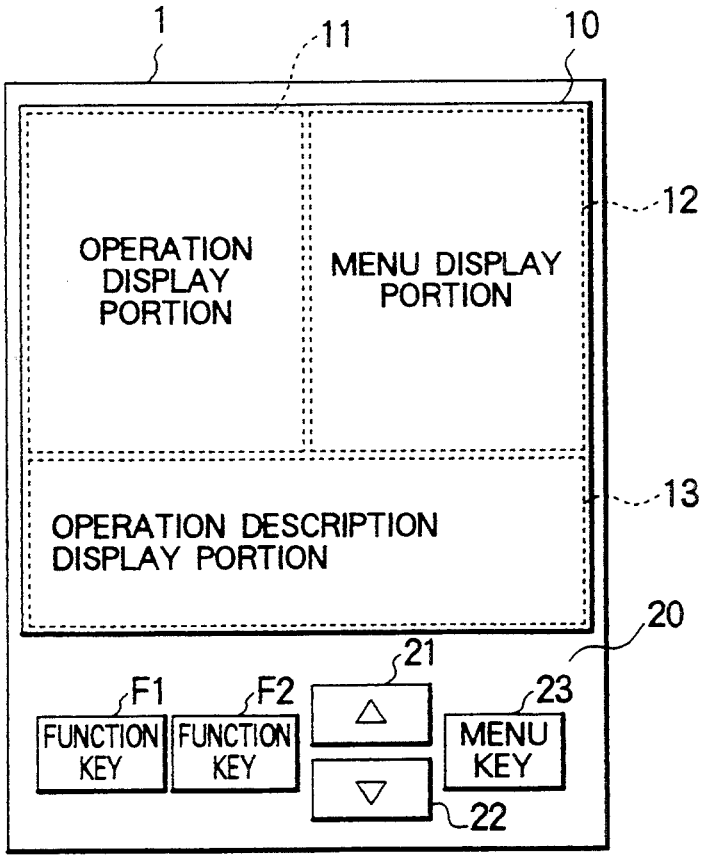
FIG. 2 is a view which illustrates a display unit used in the first embodiment.

The CPU 2 has a counter function that continuously changes the address of the fire detector or the like when a key input has been made through an operation switch 20 of the display unit 1. The display unit 1 displays the address changed by the CPU 2. The CPU 2 commands to execute the fire test of the fire detector, the address of which is displayed on the display unit FIG. 2 is a view which illustrates a specific example of the display unit 1.

The display unit 1 comprises a display panel 10 consisting of a liquid crystal panel, a CRT and so forth, and an operation switch 20.

The display panel 10 comprises an operation display portion 11 for displaying the operation of a fire alarm system, a menu display portion 12 for displaying menus and an operation description display portion 13 for displaying the description of the key operation about the contents selected from the menu displayed on the menu display portion 12.

The operation switch 20 comprises an upward scroll key 21, a downward scroll key 22, a menu selection key 23, a first function key F1 and a second function key F2.

The upward scroll key 21 is a switch for moving a cursor (having mark *) upwards displayed in the left portion of the menu displayed in the menu display portion 12 of the display panel 10, while the downward scroll key 22 is a switch for moving downwards the cursor. When either of the scroll keys or 22 is depressed once, the cursor is moved upwards or downwards by one step. In an operation for selecting the address, the upward scroll key 21 is a switch for increasing the value of the address, while the downward scroll key 22 is a switch for decreasing the value of the address.

The menu selection key 23 is a switch for selecting either "Menu" or "Menu End" displayed on the operation description display portion 13. The first function key F1 and the second function key F2 are switches for causing the operations indicated to correspond to the operation description display portion 13 to be executed.

The operation of the first embodiment will now be described.

In a normal supervisory state, a fact that a normal supervision is being performed is displayed as shown in FIG. 3A. When the menu key 23 is depressed, the fact that the normal supervision is being performed is displayed on the operation display portion 11, "Menu" is displayed in the menu display portion 12, and a description for urging a desired content to be selected from the menu by depressing the scroll keys 21 and 22 is displayed in the operation description display portion 13, as shown in FIG. 3B. When the downward scroll key 22 is depressed in this state, the fact that the normal supervision is being performed is displayed in the operation display portion as shown in FIG. 3C. Moreover, the cursor (the cursor designated by mark *) in the menu display portion 12 is moved downwards by one step so that the cursor is displayed on the left side of "Fire Test" which is the first item in the menu shown in the menu display portion 12. Further, a description "Depress selection key, and screen for setting fire test is displayed" is displayed in the operation description display portion 13, and "Selection" is displayed on the first function key F1. Further, a description is displayed for urging the first function key F1 corresponding to the selection key to be depressed if the screen for setting the fire test is intended to be displayed.

When the first function key F1 is depressed in the foregoing state, a description is, as shown in FIG. 3D, displayed in the operation description display portion 13 that "Select address by using key Δ or key ∇, and depress execution key". Thus, "address=001" is displayed in the operation description display portion 13 at a position above the upward scroll key 21 (key Δ) and the downward scroll key 22 (key ∇), the address being the address of the fire detector. By changing the foregoing address, the address of the fire detector, which is intended to be subjected to the fire test, is selected. That is, the address of the fire detector is "001" when the change to the screen for setting the fire test has been made as shown in FIG. 3D. When the upward scroll key 21 is depressed in this state, the address is continuously increased from "001" (although the address is increased step by step in a microscopic observation, it is increased continuously for the eyes of a human being). When the downward scroll key 22 is depressed, the address is continuously decreased (although the address is decreased step by step in a microscopic observation, it is decreased continuously for the eyes of a human being).

Figure 5:
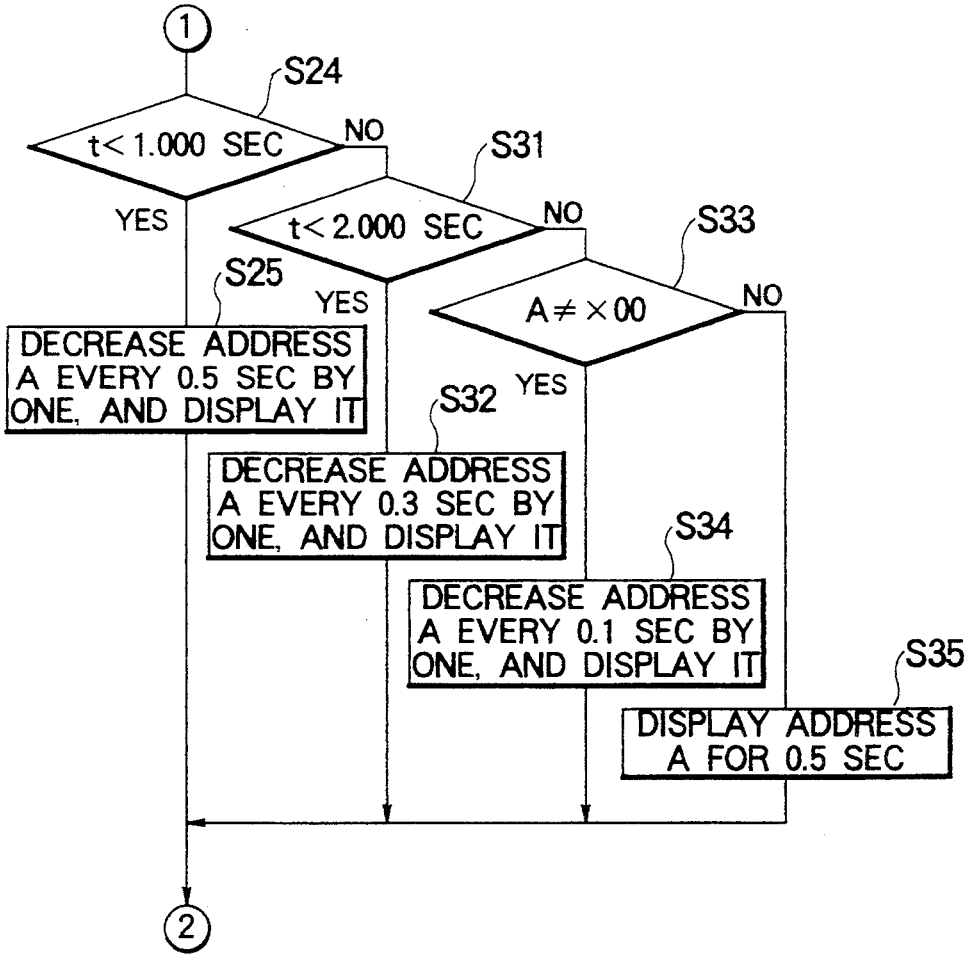
Figure 6:
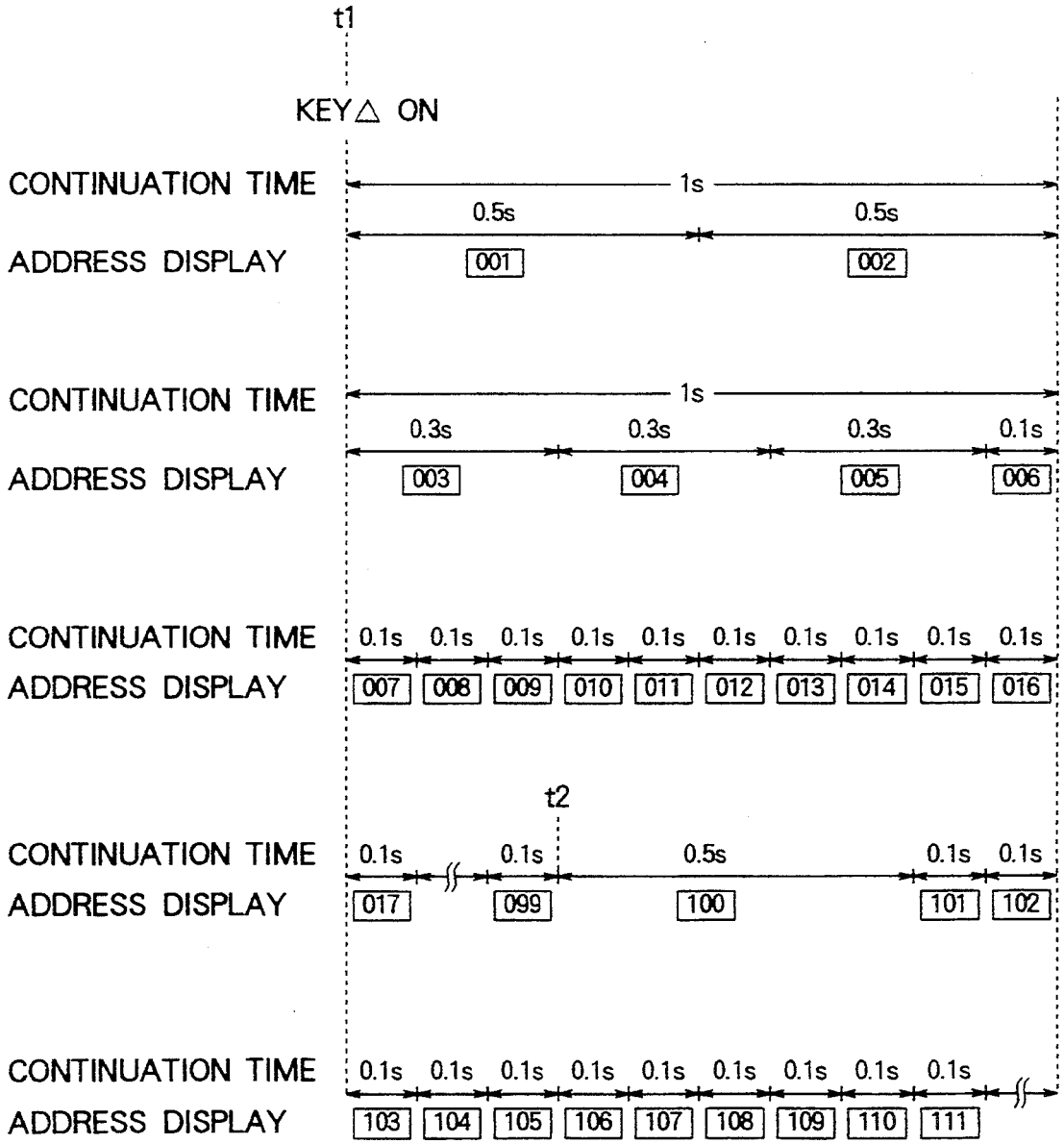
FIG. 6 is a timing chart which illustrates the operation of the first embodiment.

FIGS. 4 and 5 illustrate a flow chart of the operation of the change in the address according to the first embodiment. FIG. 6 is a time chart which illustrates the operation of the first embodiment.

When the state shown in FIG. 3C has been switched to the state shown in FIG. 3D, address A is initialized to "001" (step S1), the timer time t is initialized to 0.000 second (step S2) and a moment the upward scroll key 21 (key Δ) is turned on is waited for. When the upward scroll key 21 (key Δ) is turned on (step S3), a display is performed in such a manner that address A is, every 0.5 seconds, increased by one until the timer counts a lapse of one second of its time t (steps S4 and S5). That is, "001" is displayed as address A for 0.5 seconds from the moment the upward scroll key 21 (key Δ) has been turned on, and then "002" is displayed as address A for ensuing 0.5 seconds. In the ensuing one second, address A is increased by one every 0.3 seconds and displayed (steps S11 and S12). That is, after one second has passed from the moment the upward scroll key 21 (key Δ) has been turned on, "003" is displayed as address A for 0.3 seconds, and then "004" is displayed as address A for 0.3 seconds. Then, "005" is displayed as address A for ensuing 0.3 seconds. Then, address A is increased by one every 0.1 second until address A becomes "100" (steps S13 and S14) .

When the address has become "100", address "100" is displayed for 0.5 seconds (step S15) and address A is increased by one every 0.1 second to "199" and displayed until the address "199" is reached (steps S13 and S14). Whenever the address has become "X00" (X may be a plus integer), such as "200" or "300", the address "X00" is displayed for 0.5 seconds. Then, address A is again increased by one every 0.1 second and displayed. The time chart of the foregoing operation is show in FIG. 6. The timer time t may be reset in step S15 so that the operation similar to that in the initial stage of the scrolling operation is performed.

If the upward scroll key 21 (key Δ) is turned off during the foregoing operation, the timer time t is reset to 0.000 second. Address Aa at this time is stored in a memory (omitted from illustration). When the upward scroll key 21 (key Δ) is again turned on, address "Aa" is displayed for 0.5 seconds, address "Aa+1" is displayed for 0.5 seconds, and address "Aa+2" is displayed for 0.3 seconds. Thus, a display is made similarly to the foregoing operation.

Since the address is continuously changed at a relatively high speed when the upward scroll key 21 is operated, a desired address can be displayed in a short time. Thus, the time taken to set the address can be shortened and the address can easily be set. Further, the arrangement made in such a manner that the address is displayed for a sufficiently long time for a person to recognize the figures immediately after the upward scroll key 21 (key Δ) has been turned on makes for a user to easily recognize whether or not a portion adjacent to a desired address is displayed. In addition, the address is displayed at every unit of 100 for a time which is sufficiently long for a human being to recognize the figures so that a user is able to easily recognize whether or not a portion adjacent to a desired address is displayed. If a display of the addresses extremely near a desired address has been made, repetition of turning on/off of the upward scroll key 21 (key Δ) will cause a desired address to be displayed assuredly. If the displayed address has exceeded a desired address, the downward scroll key 22 (key ▽) is turned on.

When a desired address is thus selected, the first function key F1 corresponding to the execution key is turned on to cause the CPU 2 to command the fire detector corresponding to the selected address to be subjected to the Sire test so that the fire test is performed.

When the downward scroll key 22 (key ▽) is turned on in a state where the address is Ab (step S23), a display is made in such a manner that address Ab is decreased by one every 0.5 seconds until the timer has counted a lapse of one second of its time t (steps S24 and S25). That is, "Ab" is displayed as the address A for 0.5 seconds after the downward scroll key 22 (key ▽) has been turned on. Then, "Ab−1" is, as address A, is displayed or the next 0.5 seconds. Then, address A is, for one second, decreased by one every 0.3 seconds (steps S31 and S32). That is, after one second has passed from the moment the downward scroll key 22 (key ▽) has been turned on, "Ab−2" is, as address A, displayed for 0.3 seconds, "Ab−3" is displayed as address A for 0.3 seconds and "Ab−4" is, as address A, displayed for 0.3 seconds. Then, address A is, every 0.1 second, decreased by one and it is displayed until address A becomes "X00" (steps S33 and S34).

When the address has become "X00" (X may be any plus integer), the address is displayed for 0.5 seconds (step S35). Then, address A is decreased by one every 0.1 second until the address becomes "X00–100" (steps S33 and S34). Whenever the address has become "X00", the address is displayed for 0.5 seconds, and then address A is decreased by one every 0.1 second and displayed. Also the timer time t may be reset in step S35 as is done in step S15.

If the downward scroll key 22 (key ▽) is turned off during the foregoing operation, the timer time t is reset to 0.000 second. Address Ac at this time is stored in a memory (omitted from illustration). When the downward scroll key 22 (key ▽) is again turned on afterwards, the addresses are displayed in accordance with the same operation as described above, i.e. address "Ac" for 0.5 seconds, address "Ac−1" for 0.5 seconds and address "Ac−2" for 0.3 seconds, and so on.

Although the first embodiment is arranged in such a manner that the time in which the address is displayed is elongated if the address is a predetermined value immediately after the upward scroll key 21 (key Δ) and the downward scroll key 22 (key ▽) have been turned on, another arrangement may be employed so that each address is displayed for the same time. In this case, the structure is arranged in such a manner that the same address is displayed when both of the scroll keys 21 and 22 are turned off. By utilizing the foregoing arrangement, the upward scroll key 21 is turned on if the value of the address is intended to be increased, while the downward scroll key 22 is turned on if the value of the address is intended to be .decreased. The scroll keys 21 and 22 are turned on for an adequate time and they are turned off to observe the address displayed due to the operation of the scroll keys 21 and 22. If the address is not a desired address, the scroll keys 21 and 22 are turned on in such a manner that the time, at which they are turned on afterwards, is estimated. If the value of the address has been exceeded, the inverse direction scroll is performed. By repeating the foregoing operation, a desired address can be displayed. If proper estimation of the time, at which the scroll keys 21 and 22 are turned on afterwards, can be made by experience, the time taken to select the address can significantly be shortened.

The first embodiment is arranged in such a manner that the fire detectors are given the addresses and the address is continuously changed. A similar arrangement may be employed in which the lines are given the addresses and the address is continuously changed. Therefore, the CPU 2 is an example of an address changing means having a counter function for continuously changing the address of the fire detector or the line. The CPU 2 is also an example of a command means to issue commands for performing the selected content, such as the fire test, of the fire detector or the line, the address of which is displayed on the address display means. The fire test is an example of the selectable contents including actuating of smoke prevention and venting operation, confirmation of the set content and the like which must individually be accessed.

Although the first embodiment is arranged in such a manner that one address is displayed for 0.1 second and the next address is displayed for 0.1 second so that the address is continuously changed (continuously changed when viewed by a human being), the address may continuously be changed by displaying one address for 0.2 seconds or 0.05 seconds except the 0.1 second.

If an arrangement, which is made in such a way that terms, for example, "Class-2 Smoke Detector in Meeting Room" or "Extraordinary Class Fixed Temperature Detector in Kitchen" or "2F.Area 5", corresponding to the name or the place of the fire detector or the like are further displayed during the display of the address, is employed, the selection can easily be performed as compared with the structure in which only the numbers is used and an erroneous operation can be prevented.

Although the first embodiment is arranged in such a manner that the continuous change in the address is stopped for 0.5 seconds and 0.3 seconds, the continuous change in the address may be stopped for another time except the 0.5 seconds and the 0.3 seconds. The arrangement of the first embodiment in which the continuous change in the address is stopped for 0.5 seconds when the value of the address has become "X00" may be replaced by another structure in which the continuous change in the address is stopped for 0.5 seconds when the value of the address has become a value except "X00". In this case, the continuous change in the address may be stopped for a time except the 0.5 seconds.

According to the first embodiment, effects can be obtained in that the operation for setting the address of the fire detector or the line, which must be subjected to the fire test or the like, can easily be performed and that the operation for setting the address can quickly be completed.

SECOND EMBODIMENT

A fire receiver according to a second embodiment has an overall structure similar to that of the fire receiver according to the first embodiment shown in FIG. 1. However, seven operations can be performed in addition to the seven operations shown in the menu display portion 12 shown in FIG. 3B. The menu selection key 23 is a selection switch corresponding to "Menu 1", "Menu 2" and "Menu End" displayed in the operation description display portion 73.

The operation of the second embodiment will now be described with reference to FIGS. 7A to 7L.

Figure 7A:
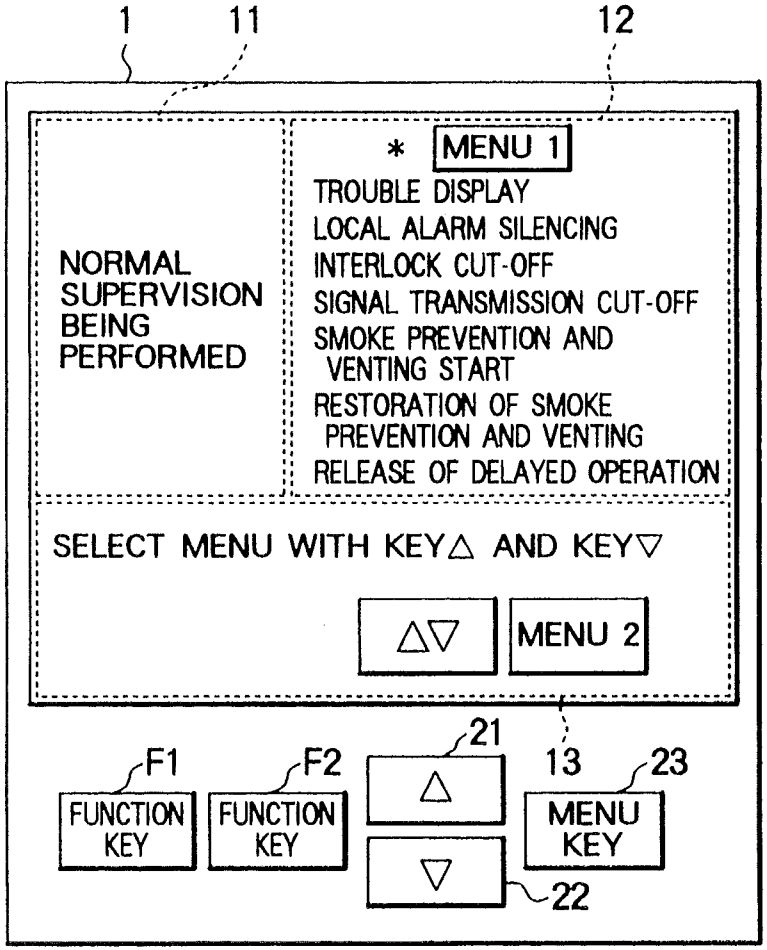
FIGS. 7A to 7L are views which illustrate examples of displays made by a display unit used in a second embodiment.
Figure 7B:
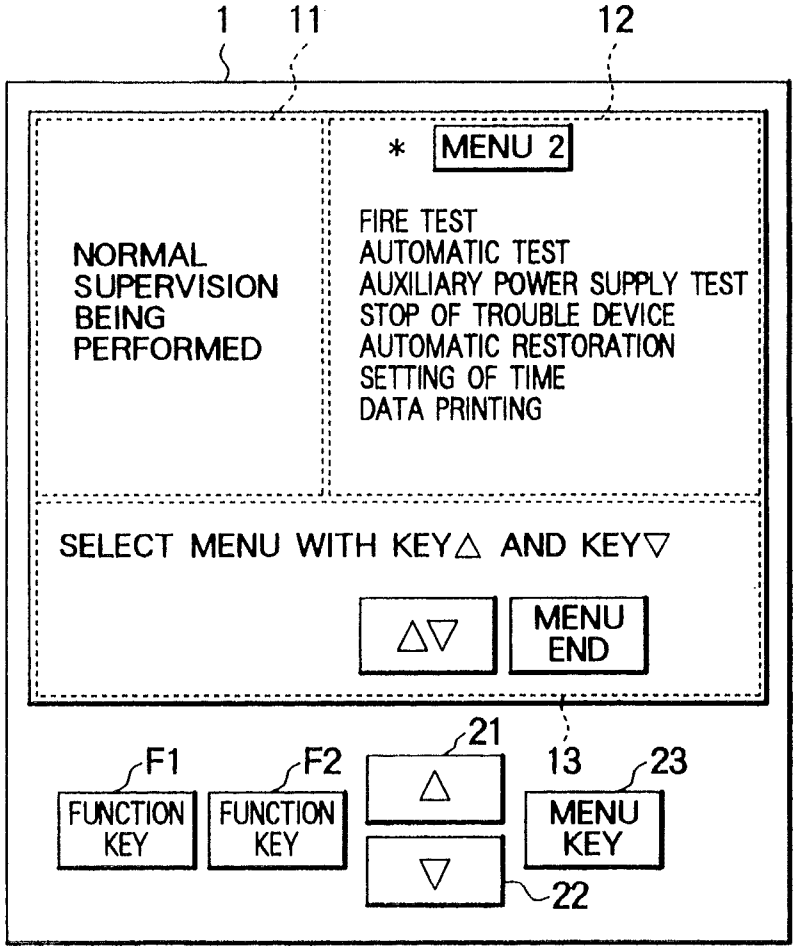

In a normal supervisory state, a fact that a normal supervision is being performed is displayed as shown in FIG. 3A. When the menu key 23 is depressed, the fact that the normal supervision is being performed is displayed on the operation display portion 11, "Menu 1", which is the first menu, is displayed in the menu display portion 12 and a description is displayed in the operation description display portion 13, and the description is displayed to urge a desired content to be selected from the Menu 1 by depressing the scroll keys 21 and 22 as shown in FIG. 7A. If the menu key 23 is depressed in this state, the fact that the normal supervision is being performed is displayed in the operation display portion 1, "Menu 2", which is the second menu, is displayed in the menu display portion 2, and a description is displayed in the operation description display portion 13 as shown in FIG. 7B, the description urging a desired content to be selected from the Menu 2 by depressing the scroll keys 21 and 22. When the menu key 23 is depressed in this state, the initial screen shown in FIG. 3A is again displayed.

FIGS. 7C to 7H are views which illustrate examples of displays when operations "Trouble Display" and "Local Alarm Silencing" are selected from the Menu 1.

Figure 7C:
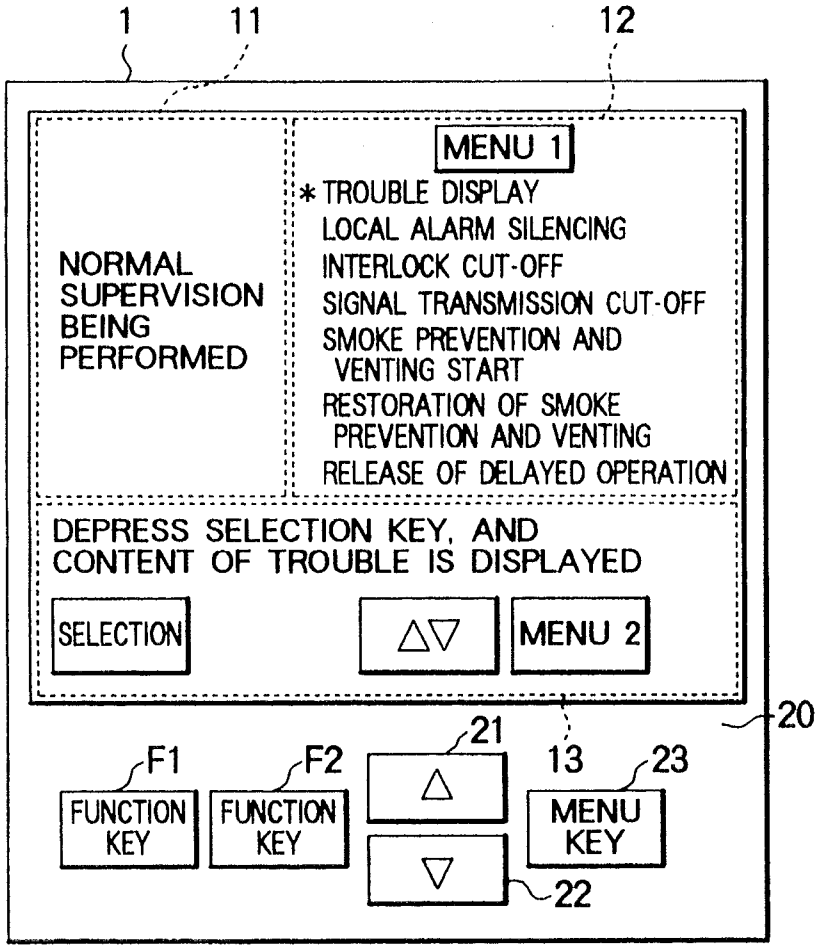
Figure 7D:
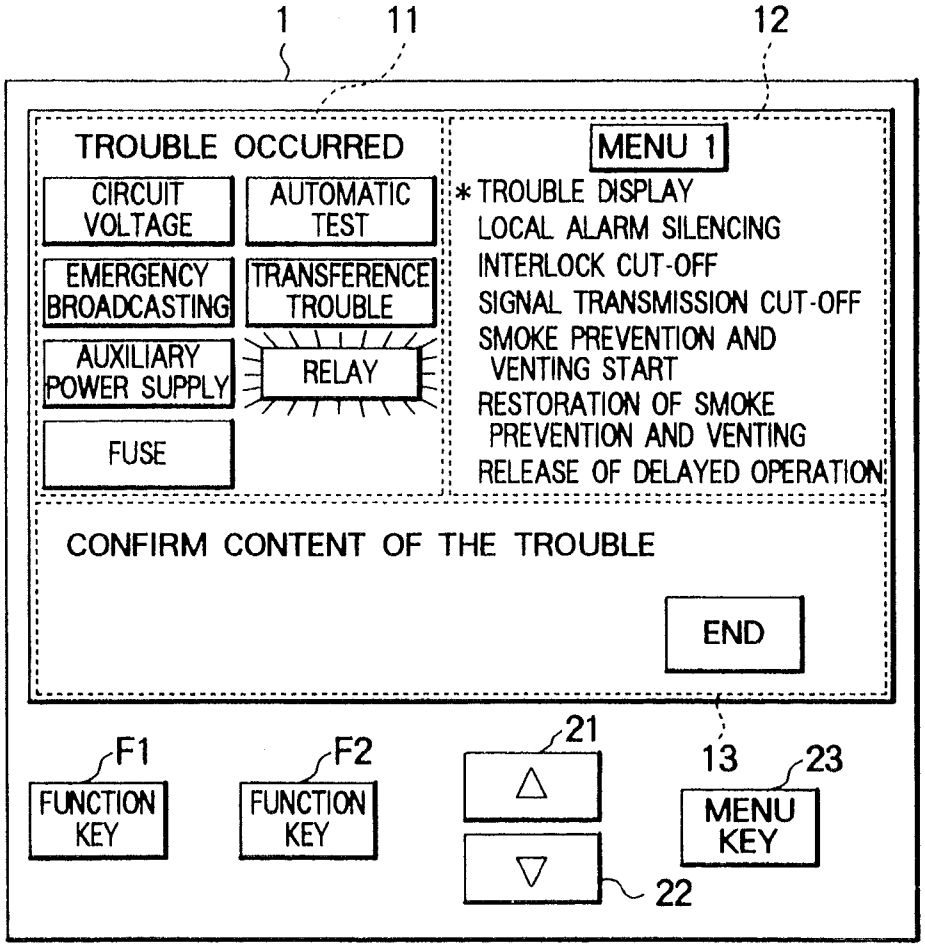

If the downward scroll key 22 is depressed once in a state shown in FIG. 7A, the cursor (a cursor designated with symbol *) shown in the menu display portion 12 is moved downwards by one step and displayed on the left side of the "Trouble Display", a description "Content of trouble is displayed if selection key is depressed" is displayed in the operation description display portion 13, and a description to urge the operator to depress the first function key F1 if he wants to look at the content of the trouble is displayed as show in FIG. 7C. If the first function key F1 is depressed in the foregoing state, the places that can be considered to have a trouble are displayed in the operation display portion 11 as shown in FIG. 7D. Among the places, the portion actually encountered the trouble is blinked, and a description reading "Confirm the Content of Trouble" is displayed in the operation description display portion 13. When the menu key 23 corresponding to completion is depressed, the state shown in FIG. 7C is restored.

Figure 7E:
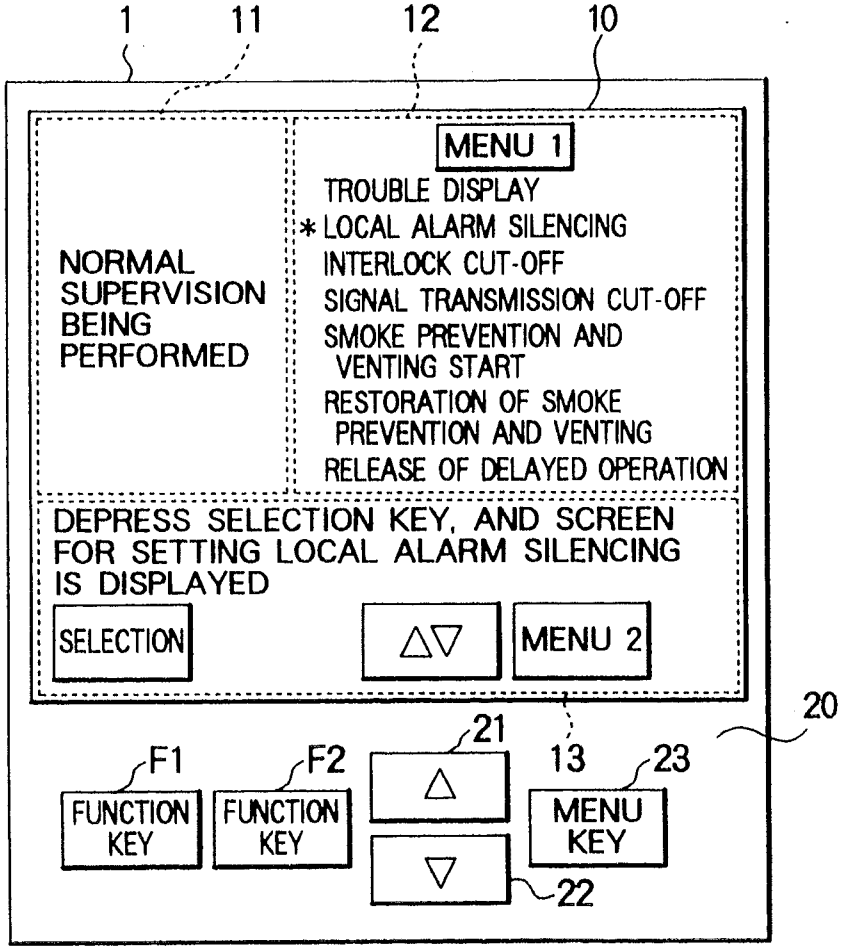
Figure 7F:
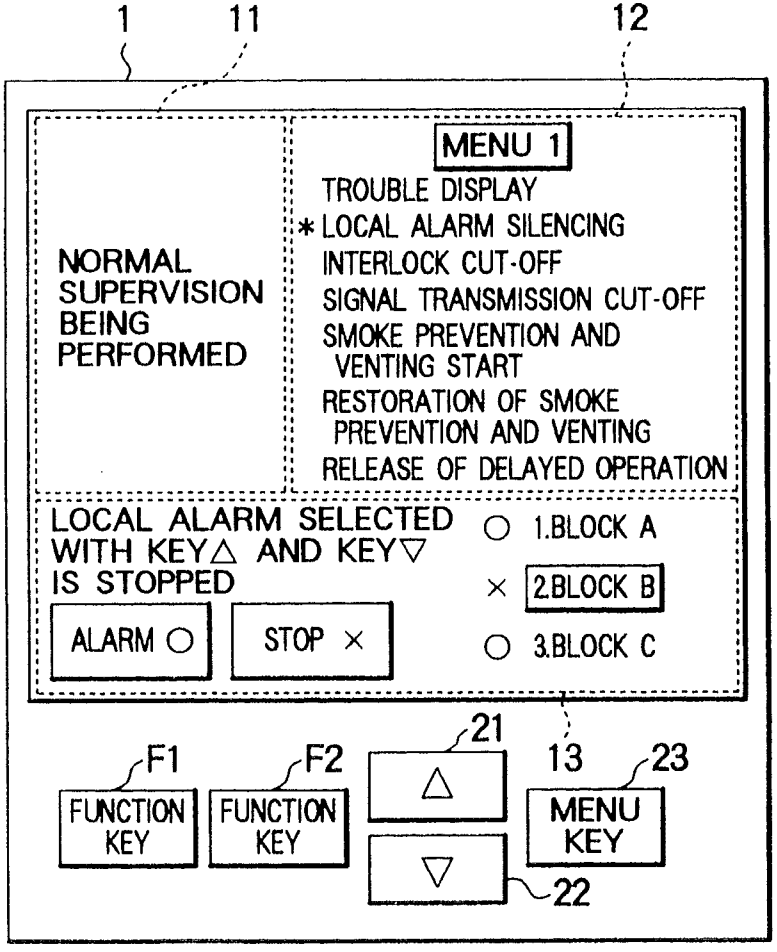

If the downward scroll key 22 is depressed once in the state shown in FIG. 7C, the cursor (the cursor designated by mark *) in the menu display portion 12 is moved downwards by one step as shown in FIG. 7E displayed on the left side of "Local Alarm Silencing" a description "Depress selection key, and screen for setting Local Alarm Silencing appears" is displayed in the operation description display portion 13, and description is made to urge the operator to depress the first function key F1 corresponding to the selection key if he wants to set Local Alarm Silencing. When the first function key F1 is depressed in the foregoing state, names of the areas, to which the local alarm can be given, are displayed in three stages composed of an upper stage, a middle stage and a lower stage so that a fact that the area displayed in the middle stage is the subject, the local alarm of which is stopped, is indicated (the name of the region is enclosed in a box), marks 0 and X are displayed on the left side of the foregoing stages so that mark 0 and mark X respectively represent alarm issue and stop, and description "Selected Local Alarm is stopped by using key Δ and key ∇" is displayed, as shown in FIG. 7F. If the key F2 (the key corresponding to "Stop X" is depressed in the foregoing state, the local alarm of "Block B" displayed in the middle stage is stopped. If the first function key F1 (the key corresponding to "Alarm 0") is depressed, the local alarm of "Block B" is given.

As described above, the operation description display portion 13 is disposed in addition to the operation display portion 11and the menu display portion 12, the operation description display portion 13 being arranged to display the description about the operations of the trouble indication or the local alarm silencing during a period in which the trouble indication or the local alarm silencing is set. Therefore, the description about the keys of the operation switch 20 located immediately below the operation description display portion 13 can quickly be understood.

If a fire takes place during the foregoing operation, a fact that the fire has taken place and the place and the like are displayed regardless of the contents of the operation. Therefore, a necessity of having a function of switching the contents to be displayed can be eliminated and a necessity for an operator to perform adequate switching can be eliminated.

Figure 7H:
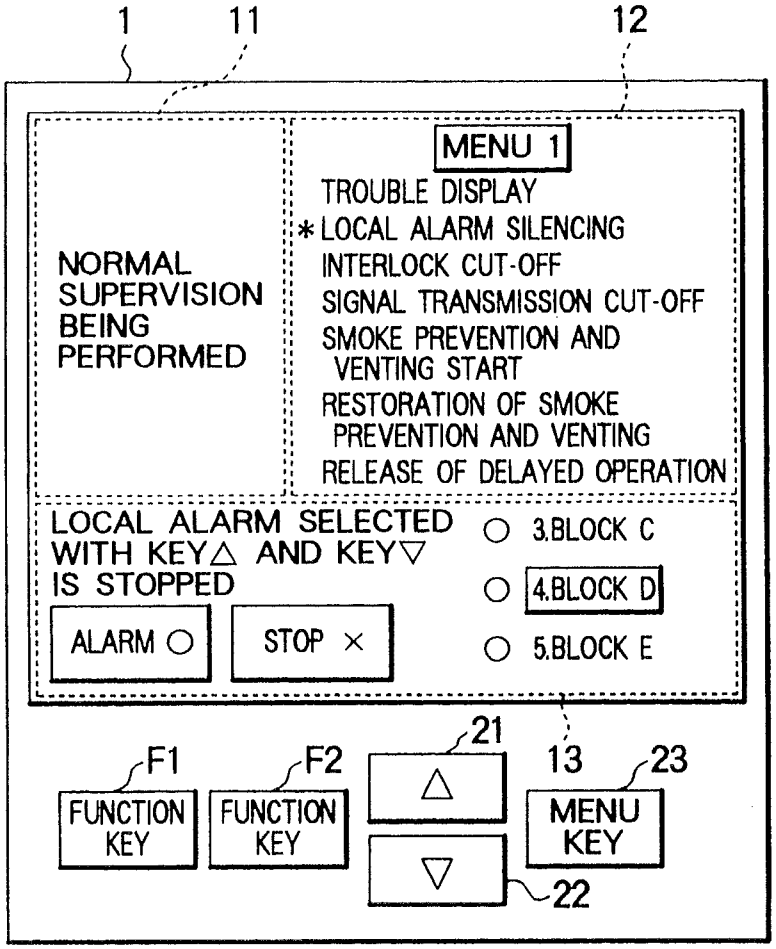
Figure 7G:
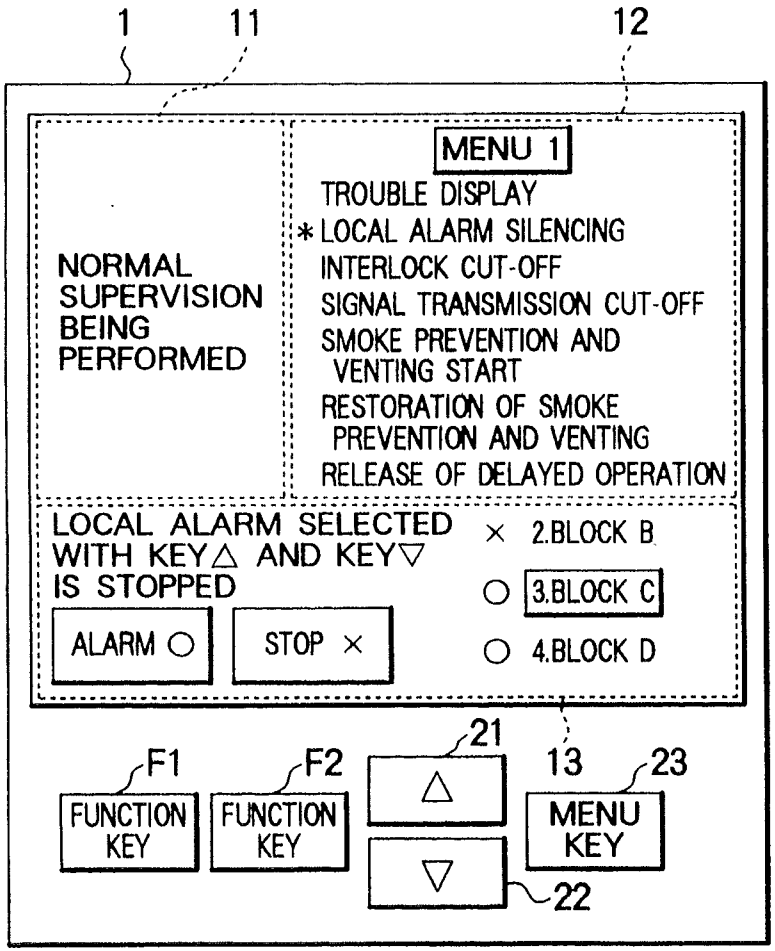

FIGS. 7F to 7H are views which illustrate the operation according to the foregoing embodiment for scrolling the names of areas, to which the local alarm can be given, in the display for silencing the local alarm.

That is, the names of areas, to which the local alarm can be given, are displayed in the three stages composed of the upper stage, the middle stage and the lower stage as shown in FIG. 7F. That is, the subject of setting the local alarm silencing is displayed in the middle stage, and subjects located in front and in the rear of the subject are displayed above the subject and the below the same. Specifically, block A is displayed in the upper stage, block B is displayed in the middle stage and block C is displayed in the lower stage. If the area for which the local alarm is to be silenced, is an area other than block B and block A, the upward scroll key 27 is, as shown in FIG. 7G, depressed once to move upwards by one step, by scrolling, the name of the area, to which the local alarm can be given, to set block C as the subject, the local alarm of which is silenced. In a case where block D is set as the subject, the local alarm of which is silenced, the upward scroll key 21 is additionally depressed one more time, the name of the area, to which the local alarm can be given, is moved upwards by one step by scrolling as shown in FIG. 7H. In a case where a block disposed in front of block D (block C, B or A or the like) is set as the subject of the area, for which the local alarm is to be silenced, the downward scroll key 22 should be depressed on the contrary.

Since the subjects located in front and in the rear of the displayed subject, to which the local alarm is silenced, are displayed above and below the subject as described above, the horizontal positional relationship of the subjects of setting can easily be understood. Therefore, setting can conveniently be performed.

The foregoing embodiment is arranged in such a manner that the names of the areas, to which the local alarm can be given, are displayed in the upper, middle and the lower stages, the subject of setting the local alarm silencing is displayed in the middle stage and the subjects located in front and in the rear of the subject of setting are displayed above and below the subject. As an alternative to the foregoing arrangement, another arrangement may be employed in which the names of the areas, to which the local alarm can be given, are displayed on three rows composed of right, middle and left rows, the subject of setting the local alarm silencing is displayed on the middle row and the subjects located in front and in the rear of the subject are displayed on the two sides of the subject.

In a case where five subjects, such as the names, the area to which the local alarm can be given, are present and the subjects to be displayed for five stages are actually displayed for three stages, the first, second and the third subjects are first displayed. If the upward scroll key 21 is depressed in this state, a blank stage, the first subject and the second subject are displayed so that the operator is able to recognize that the first subject is the leading subject.

When the downward scroll key 22 is depressed once, the first, second and the third subjects are displayed and the initial state is restored. When the downward scroll key 22 is additionally depressed one time, the second, third and the fourth subjects are displayed. When the downward scroll key 22 is additionally depressed two times in the foregoing state, the fourth subject, the fifth subject and a blank stage are displayed. Therefore, the operator is able to recognize that the fifth subject is the final subject.

That is, the arrangement made in such a manner that the empty stage is displayed in front of the first subject to be displayed and in the rear of the final stage will enable the first subject stage and the final subject stage to be recognized for the operator. Although the foregoing embodiment is arranged in such a way that the middle stage of the displayed three stages displays the subject of setting and the subject is enclosed in a box, the box may be positioned on another stage. The box may be made movable freely to move the position of the subject of setting. Furthermore, the number of stages capable of displaying the subjects may be determined to be an arbitrary number.

If the subjects are displayed on a plurality of lines, a similar arrangement may be employed in which the blank line is displayed in front of the first subject to be displayed and in the rear of the final subject. Also in this case, the first and the final lines can be recognized by the operator. Although the middle line of the three lines indicates the subject of setting and the middle line is enclosed in a box, the box may be located on another line. The box may be made movable freely to move the position of the subject of setting. Furthermore, the number of lines capable of displaying the subjects may be determined to be an arbitrary number.

As an alternative to the box for indicating the subject of setting, white and black inversion display or blinking display or another display may be employed.

FIGS. 7I to 7L are views which illustrate examples of displays realized when an operation "Interlock Cut-off" or "Signal Transmission Cut-off" is selected from the Menu 1 shown in FIG. 7E.

Figure 7J:
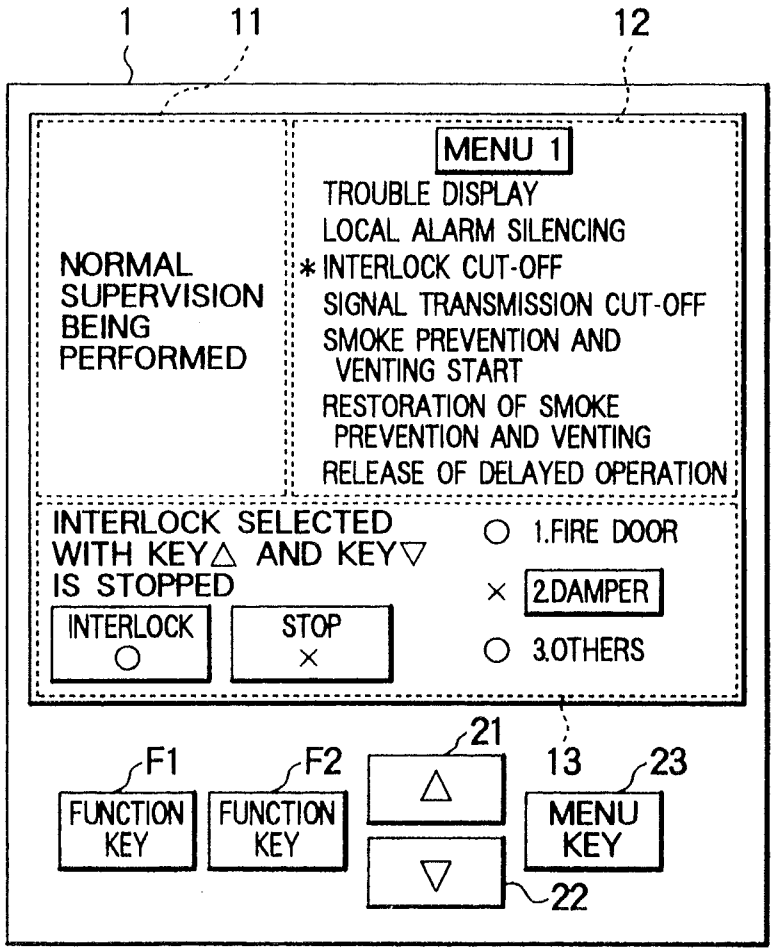
Figure 7I:
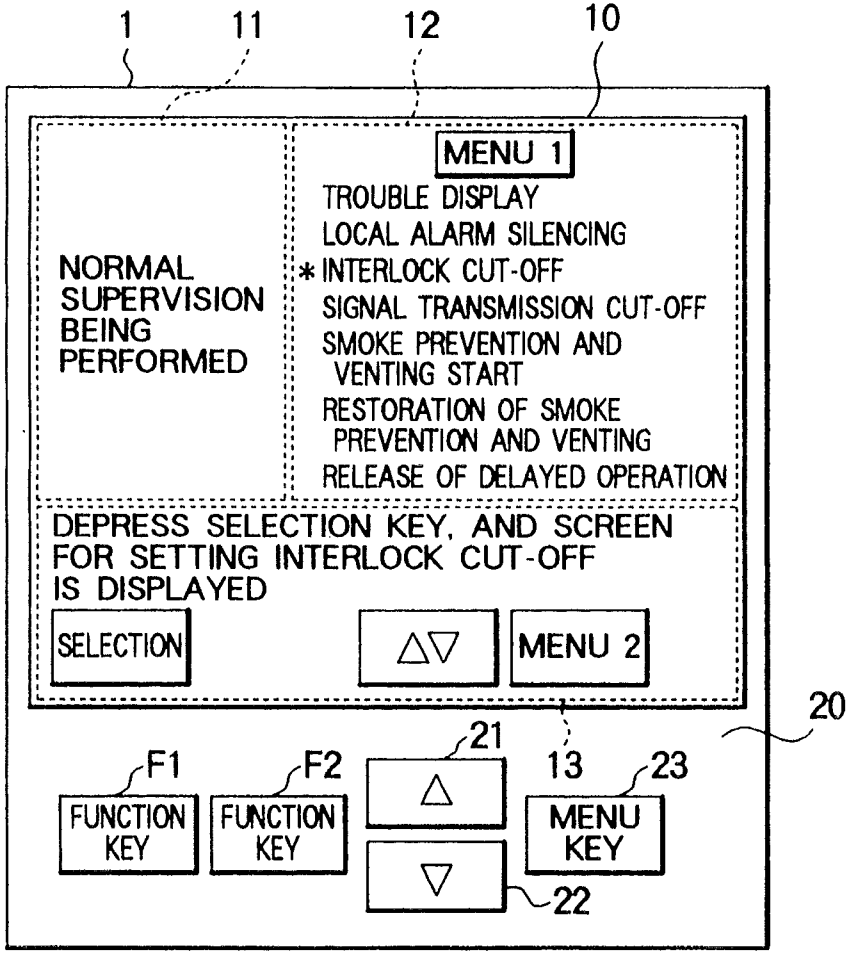

When the downward scroll key 22 is depressed once in a state shown in FIG. 7E, the cursor (the cursor designated by mark *) in the menu display portion 12 is moved downwards by one step and displayed on the left side of "Interlock Cut-off", a description reading "Depress selection key, and screen for setting Interlock Cut-off is realized" is displayed in the operation description display portion 13, and a description is displayed which urges the operator to depress the first function key F1 corresponding to the selection key if he wants to see the screen for setting the Interlock Cut-off as shown in FIG. 7I. When the first function key F1 is depressed in the foregoing state, terminals (subjects) that can be interlocked are displayed on the upper, middle and the lower stages in the operation description display portion 13 indicating that the middle terminal is the subject of the interlock cut-off (the name of the terminal is enclosed in a box), marks 0 and X are displayed on the left side of each stage to represent such that mark 0 and mark X respectively mean interlock and cut-off, a description "Selected interlock is cut-off with key and key ▽" is displayed, as shown in FIG. 7J. When the second function key F2 (the key corresponding to "Cut-off X") is depressed, "Damper" displayed in the middle stage is cut-off. When the first function key F1 (the key corresponding to "Interlock 0") is depressed, "Damper" displayed in the middle stage is interlocked. By displaying the subject of setting with a term such as the name, for example, "Damper", or the place, the subject of setting can easily be selected. Therefore, an error in setting can be prevented.

Figure 7L:
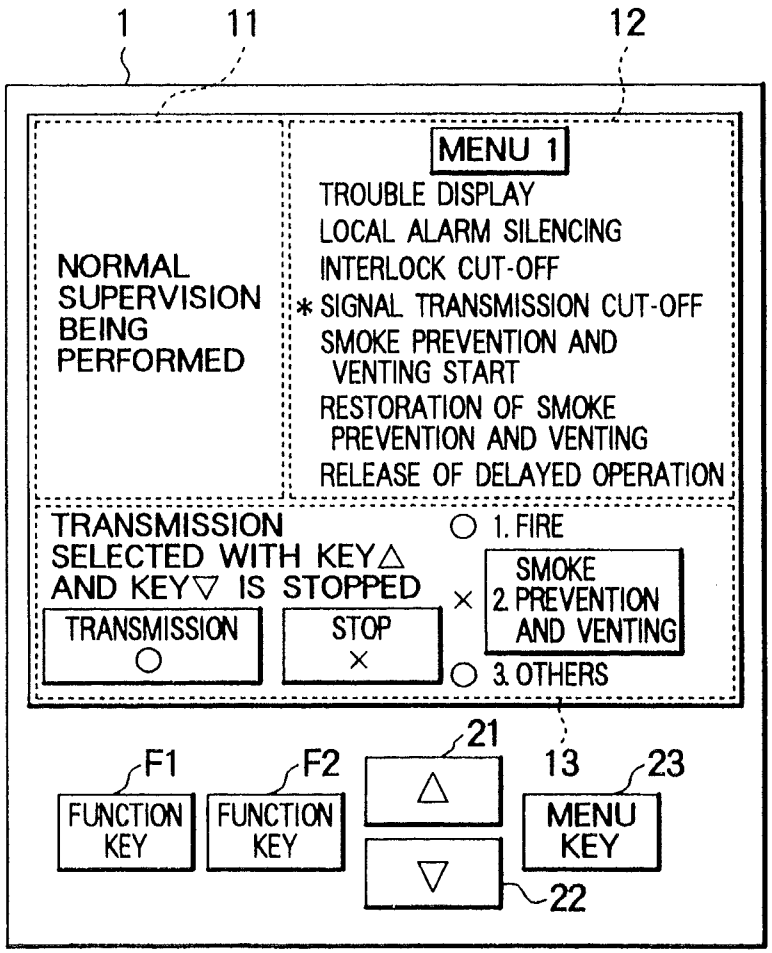
Figure 7K:
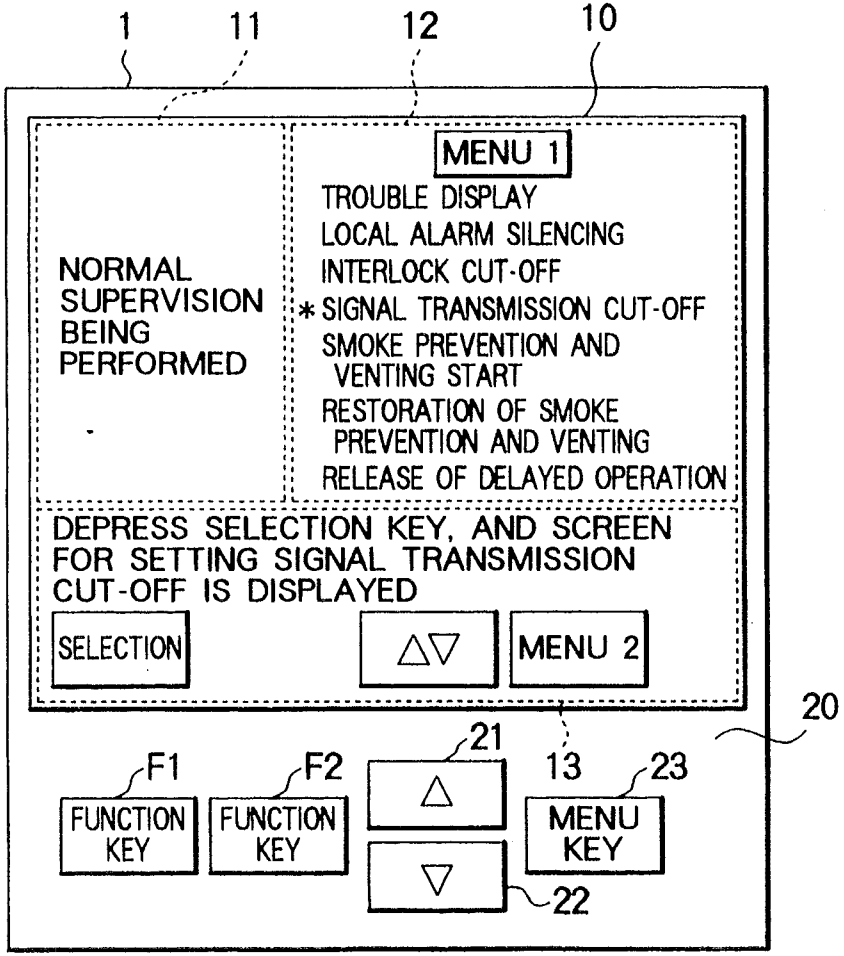

If the downward scroll key 22 is depressed once in the state shown in FIG. 71, the cursor (the cursor designated with mark *) in the menu display portion 12 is moved downwards by one step and displayed on the left side of "Signal Transmission Cutoff", a description reading "Depress selection key, and screen for setting Signal Transmission Cut-off is realized" is given on the operation description display portion 13 and a description is displayed to urge the operator to depress the first function key F1 corresponding to the selection key if he wants to look at the screen for setting Signal Transmission Cut-off, as shown in FIG. 7K. When the first function key F1 is depressed in the foregoing state, the subjects to which the signal can be transmitted are displayed on the operation description display portion 13 on the upper, middle and the lower stages indicating that the subject displayed on the middle stage is the subject of the signal transmission cut-off (the name of the subject is enclosed in a box), marks 0 and X are displayed on the left side of each stage to mean that mark 0 and mark X respectively mean the signal transmission and the cut-off, and a description reading "Selected signal transmission is cut-off with key and key ▽", as shown in FIG. 7L. When the second function key F2 (the key corresponding to "Cut-off X") is depressed in the foregoing state, a display of the "Smoke Prevention and Venting" on the middle stage is cut-off. If the first function key F1 (the key corresponding to "Signal Transmission 0") is depressed, the "Smoke Prevention and Venting" displayed on the middle stage is transmitted.

As described above, the operation description display portion 13 is disposed in addition to the operation display portion 11 and the menu display portion 12, the operation description display portion 13 being arranged to display the description about the operations of the interlock cut-off and signal transmission cut-off during a period in which the interlock cut-off or the signal transmission cut-off is set. Therefore, the description about the key operation can quickly be understood.

Since the descriptions of the operations for setting the actuation of smoke prevention and venting means, restoration of the smoke prevention and venting means and release of delayed operation are made in the operation description display portion 13 in addition to the descriptions of the foregoing operations, the description about the key operation or the like can quickly be understood during the setting operation. Further, the descriptions of the operations of the fire test, an automatic test, an auxiliary power supply test, isolation of a faulty device, automatic restoration, time setting and data printing are displayed in the operation description display portion 13 during the setting operation. Therefore, the description about the key operation or the like can quickly be understood.

Although foregoing embodiment is arranged in such a manner that the cursor marked * in the menu display portion 12 is moved downwards and displayed on the left side of the "Trouble Display" or "Local Alarm Silencing" when the downward scroll key 22 is depressed to display the cursor, another arrangement may be employed in that the displays of "Trouble Display" or "Local Alarm Silencing" etc. themselves are inverted from white to black and vice versa in place of using the foregoing cursor. In short, it will do if the selected item can be recognized.

The operation description display portion 13 may be arranged in such a manner that the subject of setting related to at least one operation among the local alarm silencing, the interlock cut-off, the signal transmission cut-off, the smoke prevention and venting and the restoration of smoke prevention and venting is displayed.

According to the first and second embodiments, the operation description display portion for displaying the description of the key operation about the contents selected from the menu displayed on the menu display portion is disposed in addition to the operation display portion for displaying the operation of the fire alarm system and the menu display portion for displaying the menu. an effect can be obtained in that the description of the key operation and the like can quickly be understood.

THIRD EMBODIMENT

Figure 8:
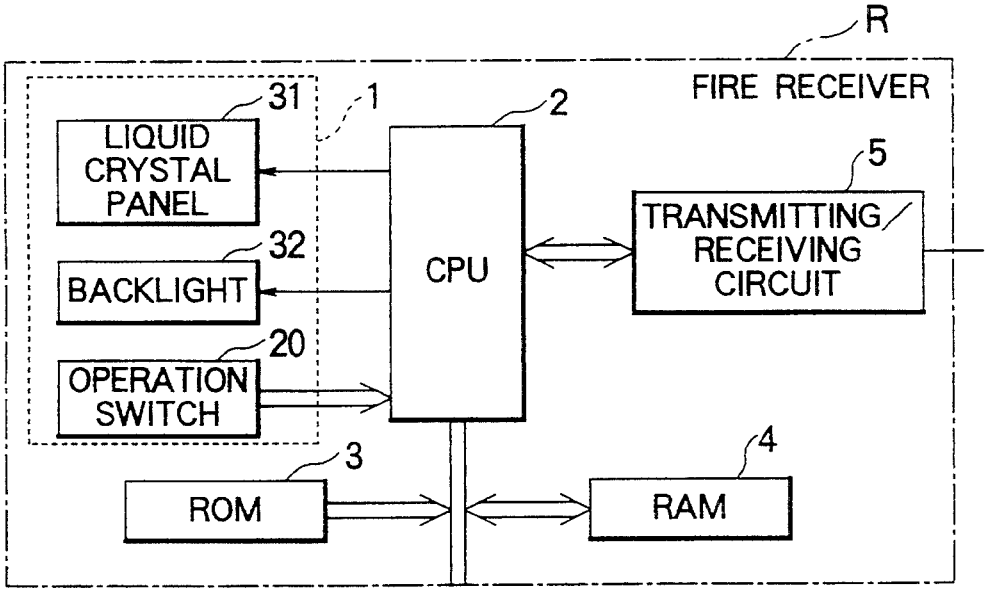
FIG. 8 is a block diagram which illustrates a fire receiver according to a third embodiment.

FIG. 8 illustrates a fire receiver R according to a third embodiment. The fire receiver R according to this embodiment has a structure that the fire receiver R according to the first embodiment shown in FIG. 1 is arranged in such a manner that a liquid crystal panel 31 is employed as the display panel 10 and a backlight 32 for irradiating the liquid crystal 31 is disposed. The ROM 3 stores a program to be executed in accordance with a flow chart shown in FIG. 9.

First, initialization is performed (step S41), the timer is caused to overflow, that is, deactivated by the CPU 2 (step S42), the timer being formed into, for example, a counter in the RAM 4 and arranged to start from 0 and allowed to overflow after a predetermined time (for example, 5 minutes) has passed. If there is no input by the operation switch 20 (step S43) and the time has overflowed (step S44), a discrimination is made whether or not the fire signal is present (step S45). If no fire signal is present, the backlight 32 is lit off (step S46). In this case, display signals are supplied to the liquid crystal panel 31 to display "Normal Supervision is Being Performed", the date and the time (step S47). If discrimination has been made that a fire signal is present (step S45), the backlight 32 is lit on (step S51) indicating fire outbreak, the date and the time on the liquid crystal panel 31 (step S52). Although in the foregoing step S45 only the discrimination is made as to whether or not the fire signal is present only, arrangements may be made to determine presence or absence of all signals, such as a trouble signal, relating to the contents to be displayed on the liquid crystal panel 31.

Since the liquid crystal panel 31 is used in the display unit 1and the predetermined contents are displayed on the liquid crystal panel 31 during the fire supervision though the backlight 32 is lit off as described above, the display can be visually recognized by the supervising staff even if the brightness level is unsatisfactory. Therefore, the supervising stuff can be freed from uneasiness whether or not the display can be made normally if a fire outbreaks. Since the backlight 32 is lit off during the fire supervision, the continuous use of the backlight 32 is prevented. Therefore, deterioration in the performance of the backlight 32 can significantly be prevented. As a result, the brightness of the display portion is raised if the fire has outbroken so that the outbreak of fire can clearly be displayed. Since the outbreak of fire can be impressed upon the supervising staff, the outbreak of fire can quickly be recognized.

If the key input has been made by operating the switch 20 (step S43), the timer is reset and started (step S67). The backlight 32 is lit on for a time (for example, 5 minutes) until the timer overflows (step S62). Thus, required items (for example, the addresses of the fire detectors required to perform a fire test and the result of the fire test if the fire test is being performed) corresponding to the contents of the input through the keys or required items, such as the outbreak of fire, the date and the time, are, if the fire signal has been received, displayed on the liquid crystal panel 31 (step S63). If key input is, in this state, again performed within a predetermined time from a moment one of the switches 20 has been depressed, the timer is again reset and started. That is, when the switch 20 is again depressed, the backlight 32 is lit on for further 5 minutes from the foregoing moment.

In step S47, only "Normal Supervision is Being Performed" may be displayed on the liquid crystal panel 31 or only the date and the time may be displayed or the other display may be made. In step S52, the displays of the date and the time may be omitted.

Figure 10:
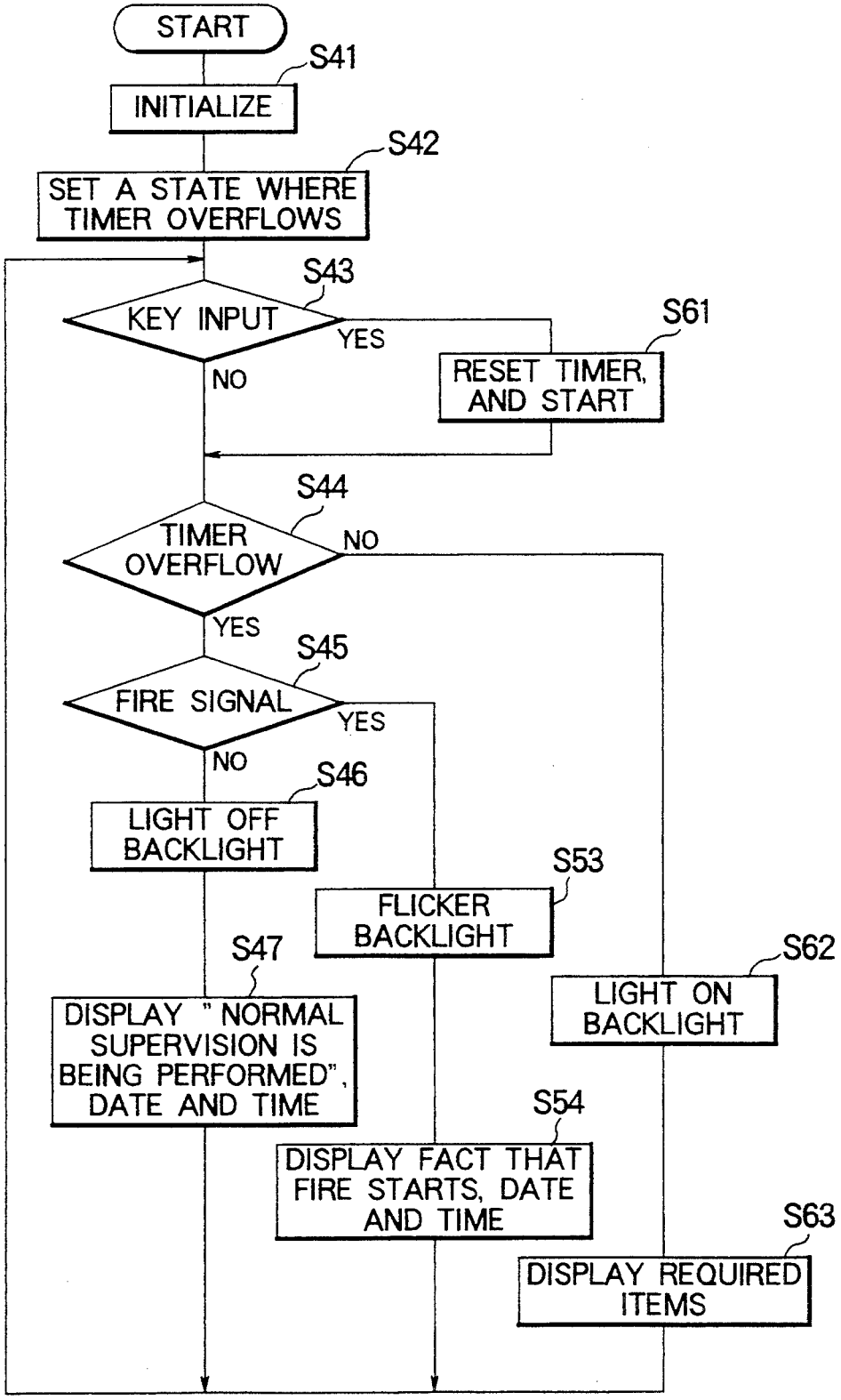
FIG. 10 is a flow chart of the operation of a modification of the third embodiment.

FIG. 10 is a flow chart which illustrates another operation of the CPU 2 according to the third embodiment.

Figure 9:
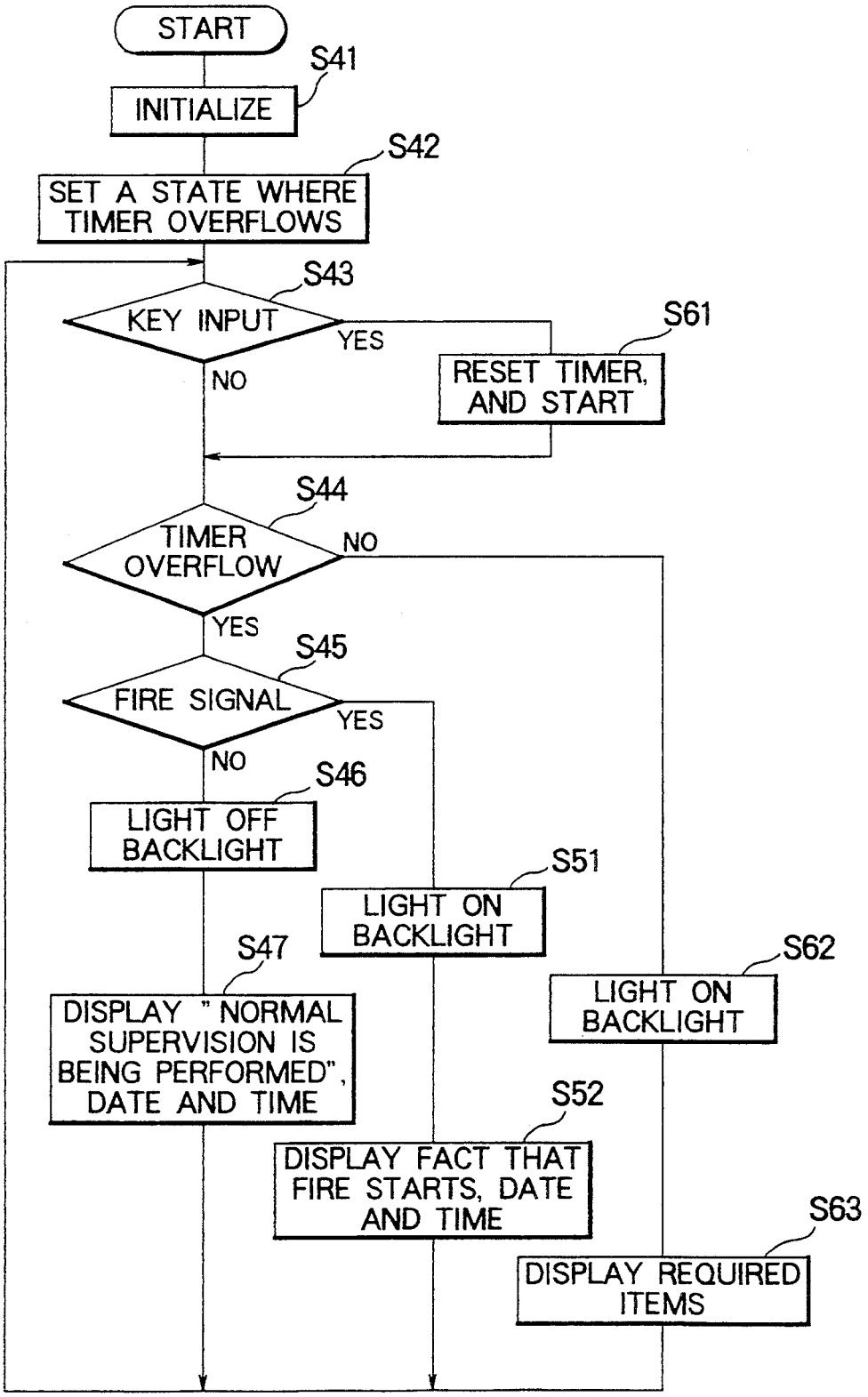
FIG. 9 is a flow chart of the operation of the third embodiment.

The operation is basically the same as the operation shown in FIG. 9 except that an arrangement is made in such a manner that if a discrimination has been made that a fire signal is present (step S45), the backlight 32 is flickered in place of lighting on the same (step S53) and the outbreak of fire, the date and the time are displayed on the liquid crystal panel (step S54). As a result of the flicker, the fact that a fire has been outbroken can be impressed on the supervising staff. If the supervising staff has made any input by using the switch 20, the flicker of the backlight 32 is completed and the backlight 32 is turned on (step S62).

FOURTH EMBODIMENT

Figure 11:
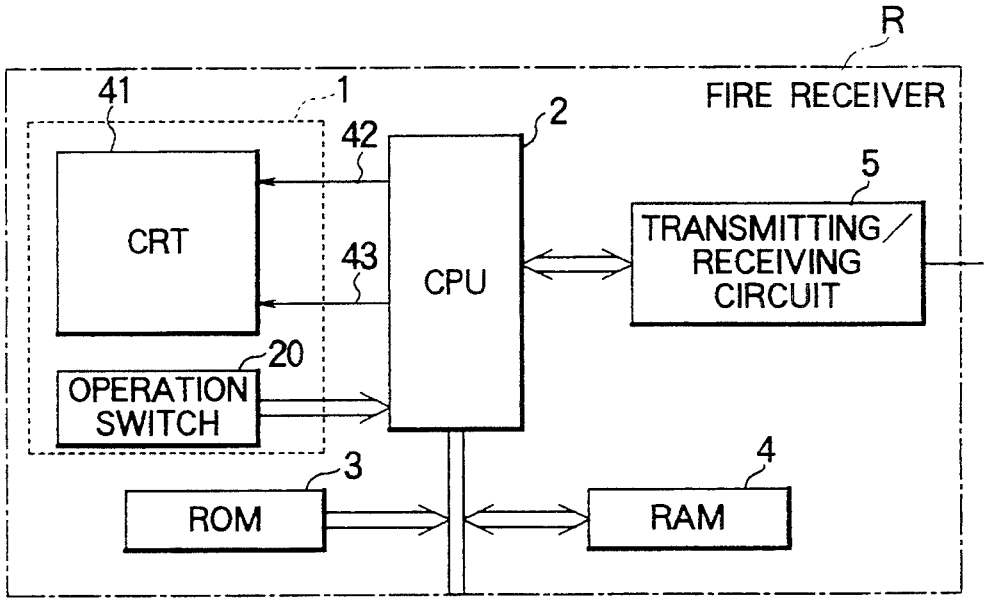
FIG. 11 is a block diagram which illustrates a fire receiver according to a fourth embodiment.

FIG. 11 is a block diagram which illustrates a fire receiver R according to a fourth embodiment of the present invention.

The fourth embodiment employs a CRT (a Cathode Ray Tube) 41 as the display unit 1, the CRT 41 being supplied with the display signal 42 and a heater electric current 43. The ROM 3 stores a program to be executed in accordance with a flow chart shown in FIG. 12.

First, initialization is performed (step S71) and the timer is caused to overflow, that is, turned off by the CPU 2 (step S72). The timer is formed into, for example, a counter in the RAM 4, the timer being started at zero and allowed to overflow after a predetermined time (for example, 5 minutes) has passed. If no input through the operation switch 20 is made (step S73) and the timer has been allowed to overflow, that is, turned off (step S74), a discrimination is made whether or not a fire signal is present (step S75). If no fire signal is present, the level of the signal for displaying the CRT 41 is lowered (step S76). In this case, display signals are supplied to the CRT 41 to display "Normal Supervision is Being Performed", the date and the time (step S77). If the fire signal is present (step S75), the level of the display signal to be supplied to the CRT 41 is raised to realize a normal state (step S81) and the outbreak of fire, the date and the time are displayed on the CRT 41 (step S82). Although in step S75 the discrimination is made as to whether or not the fire signal is present only, an arrangement may be made to descriminate presence or absence of all signals, such as the trouble signal relating to the contents to be displayed on the CRT 41.

Since the CRT 41 is employed in the display unit 1 and the predetermined contents are displayed on the CRT 41 during the supervision of fire though the brightness is low as described above, the display can be visually recognized by the supervising staff. Therefore, the supervising staff can be freed from uneasiness whether or not the display can be normally performed if a fire has outbroken. Since the level of the display signal on the CRT 41 is low, the possibility of burning of the screen or discoloration of the light emitting substance can be restricted. Further, the possibility of occurrence of lowering in the brightness can be lowered if the levels of the display signals are the same. As a result, the brightness of the display portion can be raised if a fire has outbroken so that the outbreak of fire can clearly be displayed. Therefore, the outbreak of fire can be impressed on the supervising staff so that the supervising staff is able to quickly and visually recognize the outbreak of fire.

If there is an input by operation of the switch 20 (step S73), the timer is reset and started (step S91) and the level of the display signal of the CRT 41 is raised for a time (for example, 5 minutes) until the timer is allowed to overflow (step S92). Thus, required items (for example, the addresses of the fire detectors required to perform a fire test and the result of the fire test if the fire test is being performed) corresponding to the contents of the input through the keys or required items, such as the outbreak of fire, the date and the time, are, if the fire signal has been received, displayed on the CRT 41 (step S93). If key input is, in this state, again performed within a predetermined time from a moment one of the switches 20 has been depressed, the timer is again reset and started. That is, when the switch 20 is again depressed, the CRT 41 is lit on for further 5 minutes from the foregoing moment at a high brightness.

Figure 13:
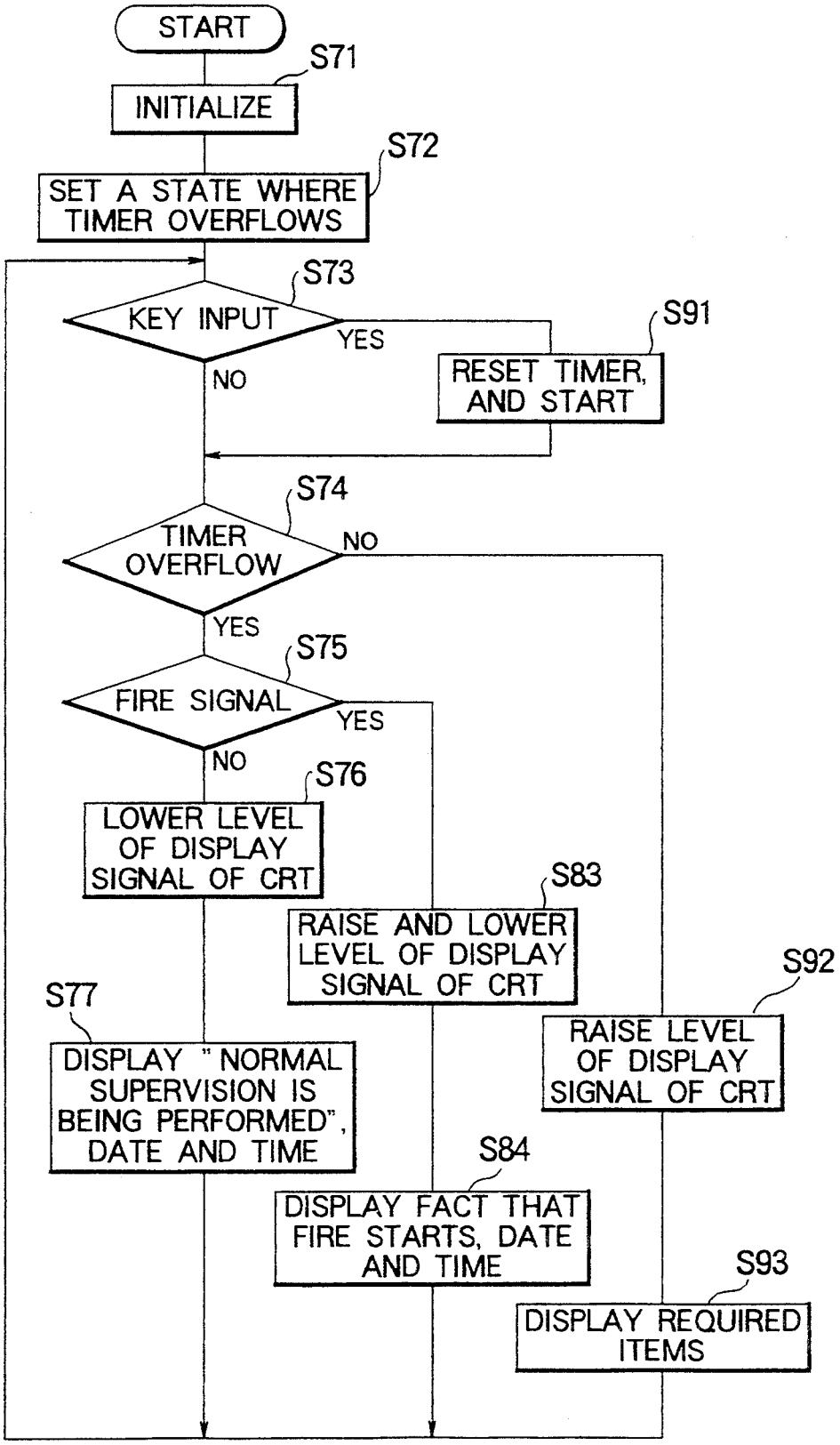
FIG. 13 is a flow chart of the operation of a modification of the fourth embodiment.

FIG. 13 is a flow chart which illustrates another operation of the CPU 2.

Figure 12:
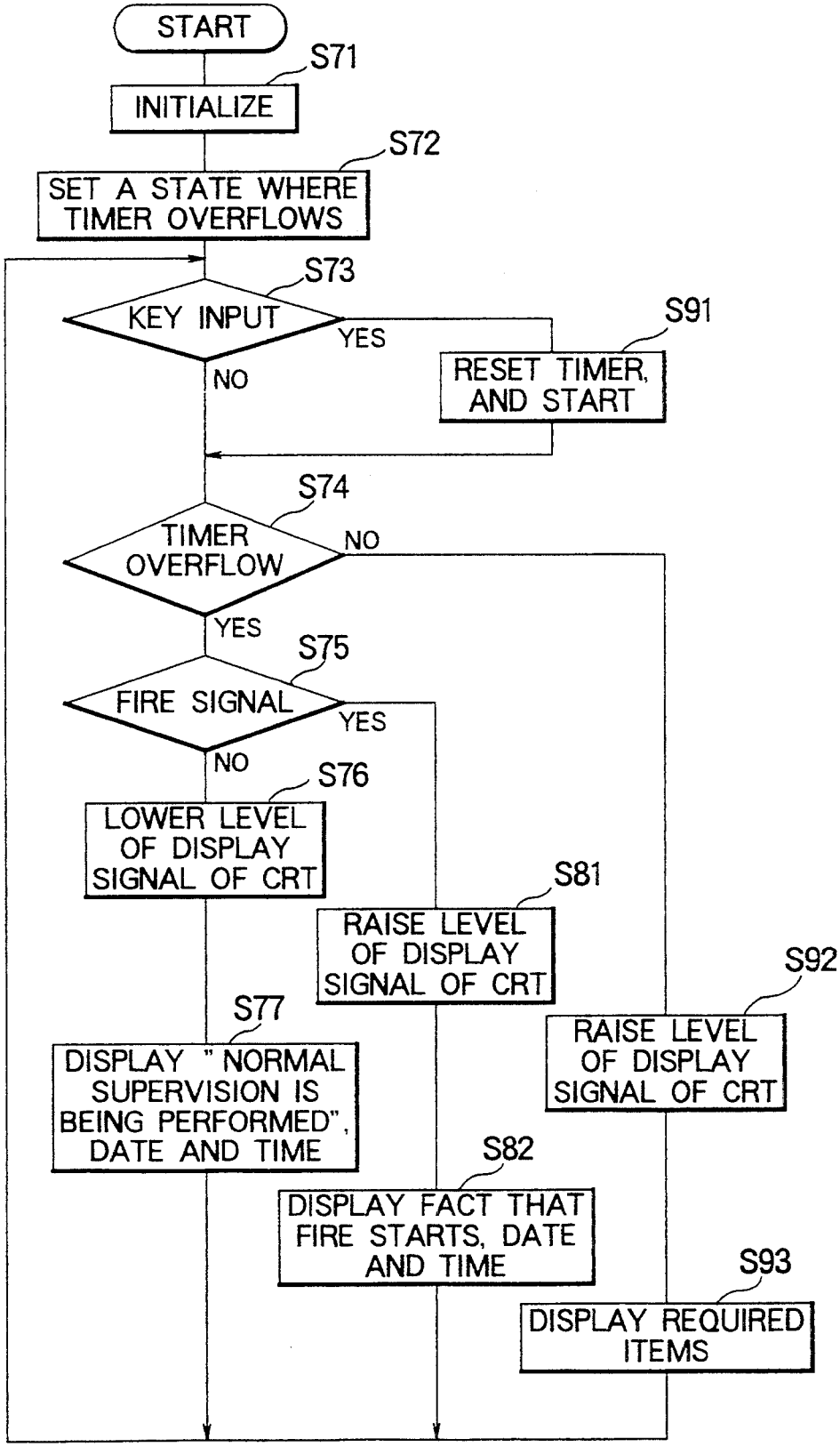
FIG. 12 is a flow chart of the operation of the fourth embodiment.

The operation is basically the same as the operation shown in FIG. 12 except that if a discrimination has been made that a fire signal is present (step S75), the CRT 41 does not make continuously display at high brightness but repeats display at a high brightness and a low brightness (step S83). At this time, the outbreak of fire, the date and the time are displayed on the CRT 41 (step S84). By the repetition of the high brightness and low brightness, the outbreak of fire can be impressed on the supervising staff. If the supervising staff has an input by using the switch 20 in the foregoing state, the repetition of the high brightness and the low brightness is completed and an operation of the continuous displaying at the high brightness is started (step S92). In step S83, another arrangement may be, in place of raising or lowering the level of the display signal, employed in which a state where the level of the display signal is high and a state where the level of the same is zero are repeated and thus the display is completely flickered.

If the lighting-off of the backlight 32 or the start of lowering of the brightness of the CRT 41 after a predetermined time has passed in the absence of input by key in the third and fourth embodiments causes any inconvenience, a means to maintain continuous lighting or to continue the high bright display may be disposed. On the contrary, a means for lighting off the backlight 32 or a means for lowering the brightness of the CRT 41 after the operation has been completed may be disposed.

Although the third and fourth embodiments describe a case where the fire signal is received as an example of fire information, the brightness of the liquid crystal panel 31 or the CRT 41 may be raised when the system has received a preliminary fire signal or fire information such as a physical quantity of a fire phenomenon such as heat, smoke or gas which can be discriminated to be a fire or a preliminary fire.

According to the third and fourth embodiments, the supervising staff can be freed from uneasiness whether or not the display can be performed normally at the time of the outbreak of fire even if the liquid crystal panel 31 or the CRT 41 is used as the display unit 1. If a fire has outbroken, the brightness of the display portion is raised so that the outbreak of fire can be displayed clearly. Since the start of the fire can be impressed on the supervising staff, an effect can be obtained in that the outbreak of fire can quickly and visually be recognized.

What is claimed is:

1. A fire receiver comprising:

operation selection switch means for selecting a desired operation from a plurality of operations that can be executed;

address selection switch means for selecting a desired address from different addresses respectively given to a plurality of fire detectors and lines;

address changing means for continuously changing the address to be selected in accordance with the operation of said address selection switch means;

address display means for displaying the address to be instructed which has been changed by said address changing means; and command means for commanding a fire detector or a line corresponding to the address displayed by said address display means to perform the operation selected by said operation selection switch means.

2. A fire receiver according to claim 1wherein said address changing means stops the continuous change of the address for a first predetermined time regardless of the operation of said address selection switch means if a predetermined address has been displayed by said address display means.

3. A fire receiver according to claim 2 wherein said address changing means stops the continuous change of the address for a second predetermined time regardless of the operation of said address selection switch means if said address changing means starts performing an address changing operation, the second predetermined time being shorter than the first predetermined time.

4. A fire receiver according to claim 1wherein said address display means also displays a term for specifying a fire detector or a line corresponding to the address to be displayed.

5. A fire receiver according to claim 1wherein said address selection switch means comprises an upward scroll key and a downward scroll key.

6. A fire receiver according to claim 1wherein said address display means includes a liquid crystal panel.

7. A fire receiver according to claim 1 wherein said address display means includes a CRT.

8. A fire receiver connected to devices in a fire alarm system, said fire receiver comprising:

a CPU;

operation switch means connected to said CPU;

a transmitting/receiving circuit connected to said CPU and arranged to transmit/receive signals to and from said devices in said fire alarm system; and display means connected to said CPU, said display means including:

an operation display portion for displaying the state of the operation performed by said fire alarm system;

a menu display portion for displaying a plurality of menus of the contents of operations; and an operation description display portion for displaying the description of a switch operation about the contents of the operation of a menu of said plurality of said menus of the contents of the operations displayed in said menu display portion that has been selected by said operation switch means.

9. A fire receiver according to claim 8 wherein said operation description display portion displays information denoting a subject device, at least one operation of which is set from among stop of local alarm, interlock stopping, retransmission stopping, start of fire-block and smoke exhausting and restoration of fire-block and smoke exhausting.

10. A fire receiver according to claim 9 wherein said operation description display portion displays information denoting the devices disposed in front and in the rear of said displayed subject device, said information being displayed on the two sides of the information of said displayed subject device.

11. A fire receiver according to claim 9 wherein said operation description display portion displays said subject device by means of terms.

12. A fire receiver according to claim 8 wherein said display means includes a liquid crystal panel.

13. A fire receiver according to claim 8 wherein said display means includes a CRT.

14. A fire receiver according to claim 8 wherein said CPU causes said display means to display a predetermined content at a low brightness if said fire alarm system is supervising a fire and causes said display means to display a predetermined content at a high brightness if fire information has been supplied from said devices in said fire alarm system through said transmitting/receiving circuit.

15. A fire receiver according to claim 14 wherein said display means includes a liquid crystal panel.

16. A fire receiver according to claim 15 wherein said display means includes a backlight for irradiating said liquid crystal panel.

17. A fire receiver according to claim 16 wherein said CPU lowers the brightness of display performed by said liquid crystal panel by lighting off said backlight and raises the brightness of display performed by said liquid crystal panel by lighting on said backlight.

18. A fire receiver according to claim 17 wherein said CPU flashes on and off said backlight when said CPU has received fire information from said device in said fire alarm system through said transmitting/receiving circuit and continuously lights on said back light when said operation switch means has been operated in a predetermined manner.

19. A fire receiver according to claim 14 wherein said display means includes a CRT.

20. A fire receiver according to claim 19 wherein said CPU continuously raises or lowers the brightness of said CRT when said CPU has received fire information from the device in said fire alarm system through said transmitting/receiving circuit and causes said CRT to perform a display when said operation switch means has been operated in a predetermined manner.

* * * * *